US008876443B2

(12) United States Patent
Mirchandani

(10) Patent No.: US 8,876,443 B2
(45) **Date of Patent: *Nov. 4, 2014**

(54) COMPOSITE CEMENTED CARBIDE ROTARY CUTTING TOOLS AND ROTARY CUTTING TOOL BLANKS

(75) Inventor: Prakash K. Mirchandani, Houston, TX (US)

(73) Assignee: Kennametal Inc., Latrobe, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/550,690

(22) Filed: Jul. 17, 2012

(65) Prior Publication Data

US 2012/0282051 A1 Nov. 8, 2012

Related U.S. Application Data

(63) Continuation of application No. 12/464,607, filed on May 12, 2009, now Pat. No. 8,272,816.

(51) Int. Cl.

| | |
|---|---|
| ***B23B 27/14*** | (2006.01) |
| ***B23B 51/02*** | (2006.01) |
| ***C22C 29/06*** | (2006.01) |
| ***C22C 1/05*** | (2006.01) |
| ***B22F 7/06*** | (2006.01) |
| *B22F 5/00* | (2006.01) |

(52) U.S. Cl.

CPC ..... *C22C 1/051* (2013.01); *C22C 29/06* (2013.01); *B22F 7/062* (2013.01); *B22F 2005/001* (2013.01)

USPC ..... 408/144; 407/118; 407/119

(58) Field of Classification Search

USPC ..... 408/144, 230; 407/53, 118, 119

IPC ..... B23B 27/14

See application file for complete search history.

(56) References Cited

U.S. PATENT DOCUMENTS

| | | | | |
|---|---|---|---|---|
| 2,240,840 | A * | 5/1941 | Fischer | 408/144 |
| 2,351,827 | A * | 6/1944 | Mcallister | 408/144 |
| 4,597,456 | A | 7/1986 | Ecer | |
| 4,813,823 | A * | 3/1989 | Bieneck | 408/59 |
| 4,881,431 | A * | 11/1989 | Bieneck | 76/108.6 |
| 4,971,485 | A * | 11/1990 | Nomura et al. | 408/144 |
| 5,094,571 | A * | 3/1992 | Ekerot | 408/144 |
| 6,076,999 | A * | 6/2000 | Hedberg et al. | 407/66 |
| 6,402,439 | B1 * | 6/2002 | Puide et al. | 408/144 |

(Continued)

FOREIGN PATENT DOCUMENTS

| | | |
|---|---|---|
| FR | 2627541 | 8/1989 |
| GB | 2384745 | 8/2003 |

(Continued)

*Primary Examiner* — Eric A Gates

(74) *Attorney, Agent, or Firm* — Larry R. Meenan, Esq.

(57) ABSTRACT

Composite articles, including composite rotary cutting tools and composite rotary cutting tool blanks, and methods of making the articles are disclosed. The composite article includes an elongate portion. The elongate portion includes a first region composed of a first cemented carbide, and a second region autogenously bonded to the first region and composed of a second cemented carbide. At least one of the first cemented carbide and the second cemented carbide is a hybrid cemented carbide that includes a cemented carbide dispersed phase and a cemented carbide continuous phase. At least one of the cemented carbide dispersed phase and the cemented carbide continuous phase includes at least 0.5 percent by weight of cubic carbide based on the weight of the phase including the cubic carbide.

44 Claims, 11 Drawing Sheets

(56) References Cited

U.S. PATENT DOCUMENTS

| | | | | |
|---|---|---|---|---|
| 6,450,739 | B1 * | 9/2002 | Puide et al. | 408/144 |
| 6,551,035 | B1 * | 4/2003 | Bruhn et al. | 408/144 |
| 8,007,922 | B2 * | 8/2011 | Mirchandani et al. | 428/548 |
| 2006/0288820 | A1 * | 12/2006 | Mirchandani et al. | 76/108.1 |
| 2007/0042217 | A1 * | 2/2007 | Fang et al. | 428/655 |
| 2010/0278603 | A1 * | 11/2010 | Fang et al. | 408/144 |

FOREIGN PATENT DOCUMENTS

| | | | | | |
|---|---|---|---|---|---|
| JP | 59-169707 | | | 9/1984 | |
| JP | 59169707 | A | * | 9/1984 | B23B 51/02 |
| JP | 60-048207 | | | 3/1985 | |
| JP | 60048207 | A | * | 3/1985 | B23B 51/02 |
| JP | 62-034710 | | | 2/1987 | |
| JP | 62034710 | A | * | 2/1987 | B23B 51/00 |
| JP | 62-218010 | | | 9/1987 | |
| JP | 62218010 | A | * | 9/1987 | B23B 51/00 |
| JP | 02-095506 | | | 4/1990 | |
| JP | 02095506 | A | * | 4/1990 | B23B 51/00 |
| JP | 03-043112 | | | 2/1991 | |
| JP | 03043112 | A | * | 2/1991 | B23B 51/00 |
| JP | 3-73210 | | | 3/1991 | |
| JP | 03073210 | A | * | 3/1991 | B23C 5/18 |
| JP | 05-092329 | | | 4/1993 | |
| JP | 05092329 | A | * | 4/1993 | B23P 15/32 |
| JP | 10219385 | A | * | 8/1998 | C22C 29/02 |
| JP | 2000-296403 | | | 10/2000 | |
| JP | 2000-355725 | | | 12/2000 | |
| JP | 2000355725 | A | * | 12/2000 | C22C 29/08 |
| JP | 2004-160591 | | | 6/2004 | |
| JP | 2004160591 | A | * | 6/2004 | B23B 51/00 |
| SU | 1269922 | | | 11/1986 | |
| SU | 1269922 | A1 | * | 11/1986 | B23B 51/06 |

* cited by examiner

COMPOSITE CEMENTED CARBIDE ROTARY CUTTING TOOLS AND ROTARY CUTTING TOOL BLANKS

CROSS-REFERENCE TO RELATED APPLICATIONS

The present application is a continuation under 35 U.S.C. §120 of co-pending U.S. patent application Ser. No. 12/464,607, filed on May 12, 2009, the entire disclosure of which is hereby incorporated by reference herein.

BACKGROUND OF THE TECHNOLOGY

1. Field of Technology

The present invention is generally directed to rotary cutting tools and rotary cutting tool blanks having a composite construction including regions of differing composition and/or microstructure, and to related methods. The present invention is more particularly directed to multi-grade cemented carbide rotary cutting tools and tool blanks for rotary cutting tools having a composite construction wherein at least one region comprises a hybrid cemented carbide including cubic carbide, and to methods of making the rotary cutting tools and rotary cutting tool blanks. The present invention finds general application to rotary cutting tools such as, for example, tools adapted for drilling, reaming, countersinking, counterboring, and end milling.

2. Description of the Background of the Technology

Cemented carbide rotary cutting tools (i.e., cutting tools driven to rotate) are commonly employed in machining operations such as, for example, drilling, reaming, countersinking, counterboring, end milling, and tapping. Such tools are conventionally manufactured with a non-hybrid solid monolithic construction. The manufacturing process for such tools involves consolidating metallurgical powder (comprised of particulate ceramic and metallic binder) to form a compact. The compact is then sintered to form a cylindrical tool blank having a monolithic construction. As used herein, the term "monolithic construction" means that a tool is composed of a solid material such as, for example, a cemented carbide, having substantially the same characteristics at any working volume within the tool. Subsequent to sintering, the tool blank is appropriately machined to form the cutting edge and other features of the particular geometry of the rotary cutting tool. Rotary cutting tools include, for example, drills, end mills, reamers, and taps.

Rotary cutting tools composed of cemented carbide are adapted to many industrial applications, including the cutting and shaping of materials of construction such as metals, wood, and plastics. Tools made of cemented carbide are industrially important because of the combination of tensile strength, wear resistance, and toughness that is characteristic of these materials. As is known in the art, cemented carbide is comprised of at least two phases: at least one hard ceramic component and a softer matrix of metallic binder. The hard ceramic component may be, for example, carbides of elements within groups IVB through VIB of the periodic table. A common example is tungsten carbide. The binder may be a metal or metal alloy, typically cobalt, nickel, iron, or alloys of these metals. The binder "cements" regions of the ceramic component within a matrix interconnected in three dimensions. Cemented carbides may be fabricated by consolidating a metallurgical powder blend of at least one powdered ceramic component and at least one powdered metallic binder.

The physical and chemical properties of cemented carbides depend in part on the individual components of the metallurgical powders used to produce the materials. The properties of a cemented carbide are determined by, for example, the chemical composition of the ceramic component, the particle size of the ceramic component, the chemical composition of the binder, and the ratio of binder to ceramic component. By varying the components and proportions of components in the metallurgical powder blend, cemented carbide rotary cutting tools such as drills and end mills can be produced with unique properties matched to specific applications.

The monolithic construction of rotary cutting tools inherently limits their performance and range of application. As an example, FIGS. 1(*a*) and 1(*b*) depict side and end views, respectively, of a twist drill 20 having a typical design used for creating and finishing holes in construction materials such as wood, metals, and plastics. The twist drill 20 includes a chisel edge 21, which makes the initial cut into the workpiece. The cutting tip 24 of the drill 20 follows the chisel edge 21 and removes most of the material as the hole is being drilled. The outer periphery 26 of the cutting tip 24 finishes the hole. During the cutting process, cutting speeds vary significantly from the center of the drill to the drill's outer periphery. This phenomenon is shown in FIGS. 2(*a*) and 2(*b*), which graphically compare cutting speeds at an inner (D1), outer (D3), and intermediate (D2) diameter on the cutting tip of a typical twist drill. In FIG. 2(*a*), the outer diameter (D3) is 1.00 inch and diameters D1 and D2 are 0.25 and 0.50 inch, respectively. FIG. 2(*b*) shows the cutting speeds at the three different diameters when the twist drill operates at 200 revolutions per minute. As illustrated in FIGS. 2(*a*) and (*b*), the cutting speeds measured at various points on the cutting edges of rotary cutting tools will increase with the distance from the axis of rotation of the tools.

Because of these variations in cutting speed, drills and other rotary cutting tools having a monolithic construction will not experience uniform wear at different points ranging from the center to the outside edge of the tool's cutting surface, and chipping and/or cracking of the tool's cutting edges may occur. Also, in drilling casehardened materials, the chisel edge is typically used to penetrate the case, while the remainder of the drill body removes material from the softer core of the casehardened material. Therefore, the chisel edge of conventional non-hybrid drills of monolithic construction used in drilling casehardened materials will wear at a much faster rate than the remainder of the cutting edge, resulting in a relatively short service life for such drills. In both instances, because of the monolithic construction of conventional non-hybrid cemented carbide drills, frequent regrinding of the cutting edge is necessary, thus placing a significant limitation on the service life of the drill. Frequent regrinding and tool changes also result in excessive downtime for the machine tool that is being used.

Other types of rotary cutting tools having a monolithic construction suffer from similar deficiencies. For example, specially designed drill bits often are used for performing multiple operations simultaneously. Examples of such drills include step drills and subland drills. Step drills are produced by grinding one or more steps on the diameter of the drill. Such drills are used for drilling holes of multiple diameters. Subland drills may be used to perform multiple operations such as drilling, countersinking, and/or counterboring. As with regular twist drills, the service life of step and subland drills of a conventional non-hybrid monolithic cemented carbide construction may be severely limited because of the vast differences in cutting speeds experienced at the drills' different cutting edge diameters.

The limitations of monolithic rotary cutting tools are also exemplified in end mills. In general, end milling is considered an inefficient metal removal technique because the end of the cutter is not supported, and the length-to-diameter ratio of end mills is usually large (usually greater than 2:1). This causes excessive bending of the end mill and places a severe limitation on the depths of cut and feed rates that can be employed.

In order to address the problems associated with rotary cutting tools of a monolithic construction, attempts have been made to produce rotary cutting tools having different properties at different locations. For example, cemented carbide drills having a decarburized surface are described in U.S. Pat. Nos. 5,609,447 and 5,628,837. In the methods disclosed in those patents, carbide drills of a monolithic cemented carbide construction are heated to between 600-1100° C. in a protective environment. This method of producing hardened drills has major limitations. First, the hardened surface layer of the drills is extremely thin and may wear away fairly quickly to expose the underlying softer cemented carbide. Second, once the drills are redressed, the hardened surface layer is completely lost. Third, the decarburization step, which is an additional processing step, significantly increases the cost of the finished drill.

The limitations associated with monolithic cemented carbide rotary cutting tools have been alleviated by employing a "composite" construction, as described in U.S. Pat. No. 6,511,265 ("the '265 patent"), which is incorporated herein by reference in its entirety. The '265 patent discloses a composite rotary cutting tool including at least a first region and a second region. The tool of the '265 patent may be fabricated from cemented carbide, in which case a first region of the composite rotary cutting tool comprises a first cemented carbide that is autogenously bonded to a second region of the tool, which comprises a second cemented carbide. The first cemented carbide and the second cemented carbide differ with respect to at least one characteristic. The characteristic may be, for example, modulus of elasticity, hardness, wear resistance, fracture toughness, tensile strength, corrosion resistance, coefficient of thermal expansion, or coefficient of thermal conductivity. The regions of cemented carbide within the tool may be coaxially disposed or otherwise arranged so as to advantageously position the regions to take advantage of their particular properties.

While the invention described in the '265 patent addresses certain limitations of monolithic cemented carbide rotary cutting tools, the examples of the '265 patent primarily contain tungsten carbide. Since relatively high shear stresses are typically encountered in rotary cutting tools employed for drilling, end-milling, and similar applications, it is advantageous to employ cemented carbide grades having very high levels of strength, such as those employing tungsten carbide. Those grades, however, may not be suitable for machining steel alloys due to a reaction that can occur between iron in the steel workpiece and tungsten carbide in the rotary cutting tool. Tools used for machining steels may contain 0.5% or more cubic carbides in a monolithic conventional grade cemented carbide. The addition of cubic carbides in such tools, however, generally results in a decrease in tool strength.

Thus, there exists a need for drills and other rotary cutting tools having different characteristics at different regions of the tool, such as high strength and hardness, and which do not chemically react with the workpiece.

SUMMARY

Certain non-limiting embodiments according to the present disclosure are directed to a composite article is provided that may be selected from a composite rotary cutting tool and a rotary cutting tool blank. The composite article may include an elongate portion. The elongate portion may comprise a first region comprising a first cemented carbide, and a second region autogenously bonded to the first region and comprising a second cemented carbide. At least one of the first cemented carbide and the second cemented carbide is a hybrid cemented carbide. The hybrid cemented carbide comprises a cemented carbide dispersed phase and a cemented carbide continuous phase. At least one of the cemented carbide dispersed phase and the cemented carbide continuous phase comprises at least 0.5 percent by weight of cubic carbide based on the weight of the phase including cubic carbide.

Certain other non-limiting embodiments disclosed herein are directed to a composite article that is one of a drill, a drill blank, an end mill, a tap, and a tap blank, including an elongate portion. The elongate portion may comprise a first region comprising a first cemented carbide, and a second region autogenously bonded to the first region and comprising a second cemented carbide. At least one of the first cemented carbide and the second cemented carbide is a hybrid cemented carbide comprising a cemented carbide discontinuous phase and a cemented carbide continuous phase, wherein at least one of the cemented carbide dispersed phase and the cemented carbide continuous phase comprises at least 0.5 percent by weight cubic carbide based on the total weight of the phase of the hybrid cemented carbide including cubic carbide. In certain embodiments, the chemical wear resistance of the first cemented carbide differs from the chemical wear resistance of the second cemented carbide.

Certain additional non-limiting embodiments according to the present disclosure are directed to a method of producing an article selected from a composite rotary cutting tool and a composite rotary cutting tool blank, wherein the methods comprise preparing a hybrid cemented carbide blend. The hybrid cemented carbide blend may comprise sintered granules of a first cemented carbide grade and unsintered granules of a second cemented carbide grade. In an embodiment, at least one of the first cemented carbide grade and the second cemented carbide grade may comprise at least 0.5 percent by weight of cubic carbide based on the total weight of the particular cemented carbide grade. The hybrid cemented carbide blend may be placed into a first region of a void of a mold, and a different metallurgical powder may be placed into a second region of the void. In an embodiment, at least a portion of the hybrid cemented carbide blend may be contacted by the metallurgical powder. Embodiments of the method may include consolidating the hybrid cemented carbide blend and the metallurgical powder to form a compact, and over-pressure sintering the compact.

BRIEF DESCRIPTION OF THE DRAWINGS

The features and advantages of alloys, articles, and methods described herein may be better understood by reference to the accompanying drawings in which:

FIG. 1(*b*) depicts an end view of the twist drill depicted in FIG. 1(*a*);

FIG. 2(*b*) is a graph depicting cutting speeds of a conventional non-hybrid twist drill at the diameters D1, D2, and D3;

Figure 1A:
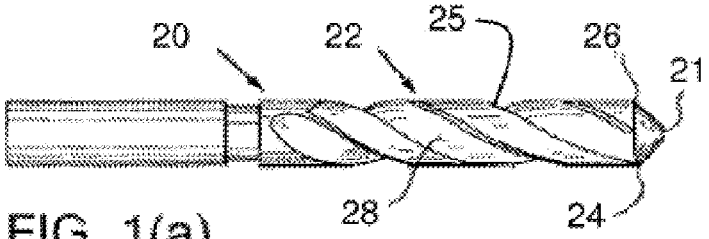
FIG. 1(*a*) depicts a side view of a twist drill having a typical design used for creating and finishing holes in construction materials such as wood, metals, and plastics.

The reader will appreciate the foregoing details, as well as others, upon considering the following detailed description of certain non-limiting embodiments according to the present disclosure.

DETAILED DESCRIPTION OF CERTAIN NON-LIMITING EMBODIMENTS

In the present description of non-limiting embodiments, other than in the operating examples or where otherwise indicated, all numbers expressing quantities or characteristics are to be understood as being modified in all instances by the term "about". Accordingly, unless indicated to the contrary, any numerical parameters set forth in the following description are approximations that may vary depending on the desired properties one seeks to obtain in tools, tool blanks, and methods according to the present disclosure. At the very least, and not as an attempt to limit the application of the doctrine of equivalents to the scope of the claims, each numerical parameter should at least be construed in light of the number of reported significant digits and by applying ordinary rounding techniques.

Any patent, publication, or other disclosure material, in whole or in part, that is incorporated by reference herein is incorporated herein only to the extent that the incorporated material does not conflict with existing definitions, statements, or other disclosure material set forth herein. As such, and to the extent necessary, the disclosure as set forth herein supersedes any conflicting material incorporated herein by reference. Any material, or portion thereof, that is to be incorporated by reference herein, but which conflicts with existing definitions, statements, or other disclosure material set forth herein is only incorporated to the extent that no conflict arises between that incorporated material and the existing disclosure material.

The present invention provides for rotary cutting tools and cutting tool blanks having a composite construction, rather than the monolithic construction of conventional non-hybrid rotary cutting tools. As used herein, a rotary cutting tool is a cutting tool having at least one cutting edge that is driven to rotate and which is brought into contact with a workpiece to remove material from the workpiece. As used herein, a rotary cutting tool having a "composite" construction refers to a rotary cutting tool having at least two regions differing in chemical composition and/or microstructure and which differ with respect to at least one characteristic or material property. The characteristic or material property may be selected from, for example, chemical wear resistance, corrosion resistance, hardness, tensile strength, mechanical wear resistance, fracture toughness, modulus of elasticity, coefficient of thermal expansion, and coefficient of thermal conductivity. Embodiments of composite rotary cutting tools that may be constructed according to the present disclosure include drills and end mills, as well as other rotary cutting tools that may be used in, for example, drilling, reaming, countersinking, counterboring, end milling, and tapping of materials.

According to certain embodiments, the present invention provides a composite rotary cutting tool having at least one cutting edge, such as a helically oriented cutting edge, and including at least two regions of cemented carbide that are bonded together autogenously and that differ with respect to at least one characteristic or material property. As used herein, an "autogenous bond" refers to a bond that develops between regions of cemented carbide or another material without the addition of filler metal or other fusing agents.

In embodiments of composite rotary cutting tools and composite rotary cutting tool blanks disclosed herein, at least one of the regions of the tool or blank comprises a hybrid cemented carbide. A hybrid cemented carbide comprises a cemented carbide continuous phase and a cemented carbide dispersed phase. In embodiments, at least one of the cemented carbide continuous phase and the cemented carbide dispersed phase of the hybrid cemented carbide includes at least 0.5% cubic carbide by weight based on the total weight of the phase including the cubic carbide.

Transition metals belonging to groups IVB through VIB of the periodic table are relatively strong carbide formers. Certain of the transition metals form carbides characterized by a cubic crystal structure, and other transition metals form carbides characterized a hexagonal crystal structure. The cubic carbides are stronger than the hexagonal carbides. The group IVB through VIB transition metals that form cubic carbides are Ti, V, Cr, Zr, Nb, HF, and Ta. The carbides of tungsten and molybdenum have a hexagonal crystal structure, with tungsten being the weakest of the carbide formers. The cubic carbides are mutually soluble in each other and form solid solutions with each other over wide compositional ranges. In addition, the cubic carbides have significant solubility for WC and $Mo_2C$. On the other hand, WC generally has no solubility for any of the cubic carbides.

Cemented carbides based on WC as the hard and dispersed phase and Co as the metallic binder phase provide the optimal combination of strength, wear resistance, and fracture toughness. During the machining of steel alloys with WC/Co cemented carbide tools, steel chips resulting from machining the steel remain in contact with the WC/Co cemented carbide. WC is relatively unstable when contacting iron at elevated temperatures, and cratering and weakening of the WC/Co rotary tool can occur during machining of steel.

It has been observed that additions of cubic carbides to the cemented carbide of a WC/Co monolithic rotary tool reduces the interaction of WC in the rotary tool with Fe in the steel, thereby extending the life of the tool when used for machining steel alloys. However, the addition of cubic carbides to these tools also lowers tool strength, and can render the tool unsuitable for certain machining applications.

In embodiments of a composite rotary tool or rotary tool blank according to the present disclosure, the provision of hybrid cemented carbide comprising cubic carbide improves chemical wear resistance, while not significantly reducing the strength of the tool. As used herein, "chemical wear" is interchangeably referred to as corrosive wear and refers to wear in which a significant chemical or electrochemical reaction occurs between the material and the workpiece and/or the environment, resulting in wear of the material. For example, chemical wear may be observed on a rotary cutting tool due to diffusion and a chemical reaction of tungsten carbide with iron machining chips when the tool is used to machine a steel alloy.

Figure 4:
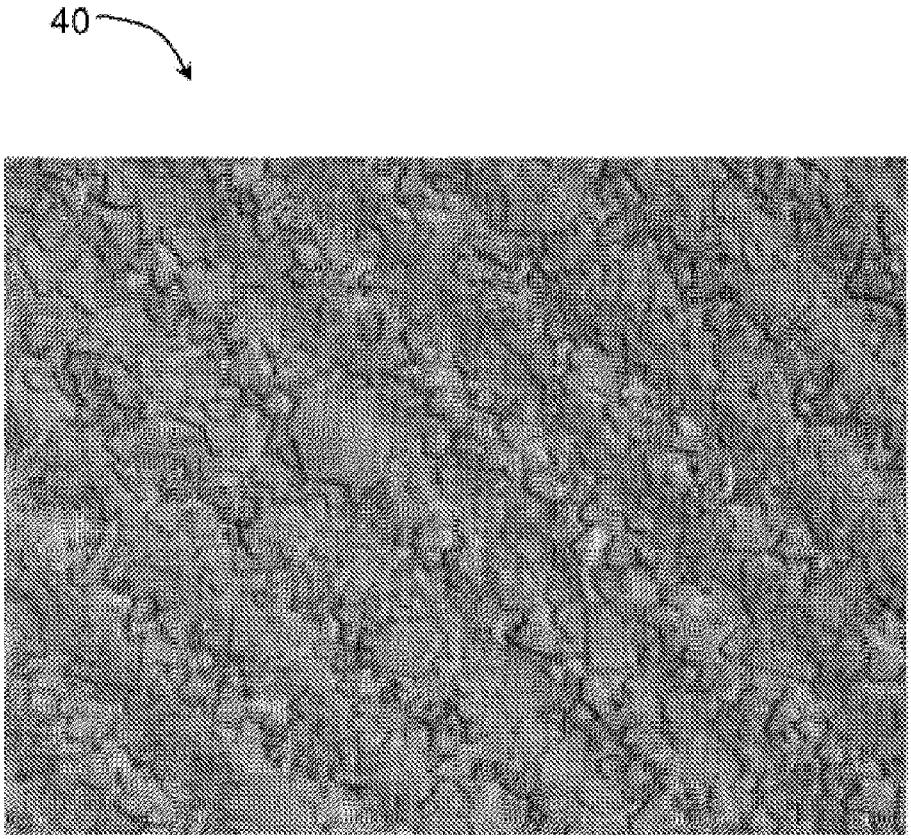
FIG. 4 PRIOR ART
FIG. 4 is a photomicrograph of a prior art conventional non-hybrid cemented carbide grade based on tungsten carbide and cobalt and lacking cubic carbide.
Figure 5:
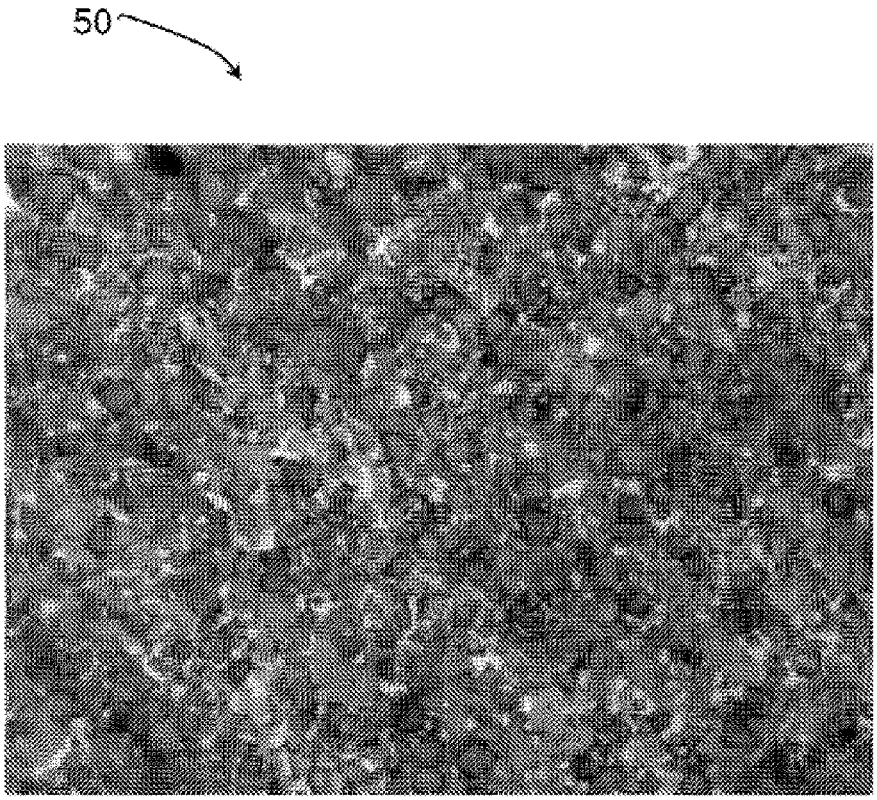
FIG. 5 PRIOR ART
FIG. 5 is a photomicrograph of a prior art conventional non-hybrid cemented carbide grade based on tungsten carbide and cobalt and including cubic carbide.

In an embodiment, one of the two autogenously bonded cemented carbide regions of the rotary cutting tool may comprise a conventional non-hybrid grade cemented carbide. A conventional non-hybrid grade cemented carbide may comprise one or more types of transition metal carbide particles and a binder metal or metal alloy. In a non-limiting example, a conventional non-hybrid grade cemented carbide may comprise hard particles of tungsten carbide embedded in a cobalt binder. An example of a conventional non-hybrid grade tungsten carbide-cobalt (i.e., WC—Co) cemented carbide is depicted in FIG. 4. The cemented carbide depicted in FIG. 4 was manufactured by compacting and sintering Firth Grade 248 cemented carbide powder blend available from ATI Firth Sterling, Madison, Ala. Firth Grade 248 cemented carbide powder blend includes about 11% by weight cobalt powder and 89% by weight tungsten carbide particles (or powder). The cemented carbide produced on compacting and sintering Firth Grade 248 powder blend includes a discontinuous phase of tungsten carbide particles embedded in a continuous cobalt binder phase. Another conventional non-hybrid grade cemented carbide is depicted in FIG. 5. The cemented carbide in FIG. 5 was manufactured from Firth Grade T-04 cemented carbide powder blend (also available from ATI Firth Sterling, Madison, Ala.). Firth Grade T-04 cemented carbide powder blend includes: 12% by weight of cobalt powder; a total of 6% by weight of titanium carbide, tantalum carbide, and niobium carbide particles; and 82% by weight of tungsten carbide particles. The cemented carbide produced on compacting and sintering Firth Grade T-04 powder blend includes a discontinuous phase including tungsten carbide particles and solid solutions of titanium carbide, tantalum carbide, and niobium carbide, embedded in a continuous cobalt binder phase As noted above, one embodiment of the present invention is directed to a composite including a first region comprising a hybrid cemented carbide comprising at least 0.5% by weight of cubic carbide based on the weight of the phase that includes the cubic carbide, autogenously bonded to a second region comprising a conventional non-hybrid cemented carbide. In another embodiment, each of the two autogenously bonded cemented carbide regions comprises a hybrid cemented carbide, and each of the two hybrid cemented carbides comprises at least 0.5% by weight of cubic carbide based on the weight of the phase of the hybrid cemented carbide that includes the cubic carbide. Each hybrid cemented carbide comprising a phase including at least 0.5% cubic carbide by total weight of the phase may exhibit improved chemical wear resistance relative to, for example, a cemented carbide based solely on tungsten carbide and cobalt. For example, the occurrence of cratering of cemented carbide tools due to the chemical wear that can occur when contacting steel workpieces is significantly reduced when the tool comprises a region contacting the workpiece that comprises hybrid cemented carbide including a continuous and/or discontinuous phase comprising at least 0.5% cubic carbide based on the total weight of the cubic carbide-containing phase. Therefore, including cubic carbide in a hybrid cemented carbide may improve the chemical wear resistance of a tool including a region comprising the hybrid cemented carbide. Also, the strength of the hybrid cemented carbide region of the tool is not significantly decreased by presence of the cubic carbide as compared with a tool made from, for example, a conventional non-hybrid grade WC—Co cemented carbide.

Aspects of certain embodiments of the present invention may be better understood by considering the rotary cutting tool blank 30 shown in FIGS. 3(*a*) and (*b*). FIG. 3(*a*) is a cross-sectional view in which the rotary cutting tool blank 30 is sectioned along a plane including the blank's central axis. FIG. 3(*b*) is a cross-sectional view in which the rotary cutting tool blank 30 is sectioned transverse to the tool's central axis. The rotary cutting tool blank 30 is a generally cylindrical sintered compact with two coaxially disposed, autogenously bonded cemented carbide regions. It will be apparent to one skilled in the art, however, that the following discussion of embodiments of the present invention also may be adapted to the fabrication of composite rotary cutting tools and rotary cutting tool blanks having more complex geometries and/or more than two regions. Thus, the following discussion is not intended to restrict the invention, but merely to illustrate certain non-limiting embodiments of the invention.

The rotary cutting tool blank 30 may include a first region 31, which may be a core region, comprising a first cemented carbide. In a non-limiting embodiment, the core region may comprise a conventional non-hybrid grade WC—Co cemented carbide providing the highest possible strength. The first cemented carbide of the first region 31 is bonded to a second region 32 comprising a second carbide, and which may be an outer region. The outer region may comprise a hybrid cemented carbide in which at least one of the continuous and dispersed phases comprises at least 0.5% cubic carbide (based on the weight of the particular phase including the cubic carbide) to provide enhanced chemical wear resistance, and without losing significant strength and mechanical wear resistance relative to the same cemented carbide lacking cubic carbide. As shown in FIGS. 3(*a*) and 3(*b*), the first region 31 and the second region 32 may be coaxially disposed. The first and second regions 31 and 32 may be autogenously bonded.

As indicated above, embodiments disclosed herein include one or more regions comprising hybrid cemented carbide. Whereas a conventional non-hybrid cemented carbide is a composite material that typically comprises transition metal carbide particles dispersed throughout and embedded within a continuous binder phase, a hybrid cemented carbide may include regions (or, as used interchangeably herein, "phases") of at least one conventional non-hybrid cemented carbide grade dispersed throughout and embedded within a continuous phase of a second conventional non-hybrid cemented carbide grade, thereby forming a composite including a first cemented carbide discontinuous phase and a second cemented carbide continuous phase. Hybrid cemented carbides are disclosed in, for example, U.S. Pat. No. 7,384,443 ("the '433 patent"), which is incorporated herein by reference in its entirety. The discontinuous cemented carbide phase and continuous cemented carbide phase of each hybrid cemented carbide typically, and independently, comprise particles of a carbide of one or more of the transition metals, for example, titanium, vanadium, chromium, zirconium, hafnium, molybdenum, niobium, tantalum, and tungsten. The two phases of the hybrid cemented carbide also each comprise a continuous metallic binder phase (or, more simply, a continuous metallic binder) that binds together or cements all of the carbide particles in the particular phase of the hybrid cemented carbide. The continuous metallic binder phase of each cemented carbide of the hybrid cemented carbide may include cobalt, a cobalt alloy, nickel, a nickel alloy, iron, or an iron alloy. Optionally, alloying elements such as, for example, tungsten, chromium, molybdenum, carbon, boron, silicon, copper manganese, ruthenium, aluminum, and silver may be present in the binder phase of or both cemented carbide of the hybrid cemented carbide, in relatively minor concentrations to enhance different properties. When referring to hybrid cemented carbides herein, the terms "dispersed phase" and "discontinuous phase" are used interchangeably.

As discussed above, an aspect of hybrid cemented carbides that may be included in a region of the composite articles disclosed herein is that at least one of the cemented carbide continuous phase and the cemented carbide discontinuous phase of the hybrid cemented carbide comprises at least 0.5 percent by weight cubic carbide, wherein the weight percentage is based on the total weight of the phase of the hybrid cemented carbide containing the cubic carbide.

Figure 6:
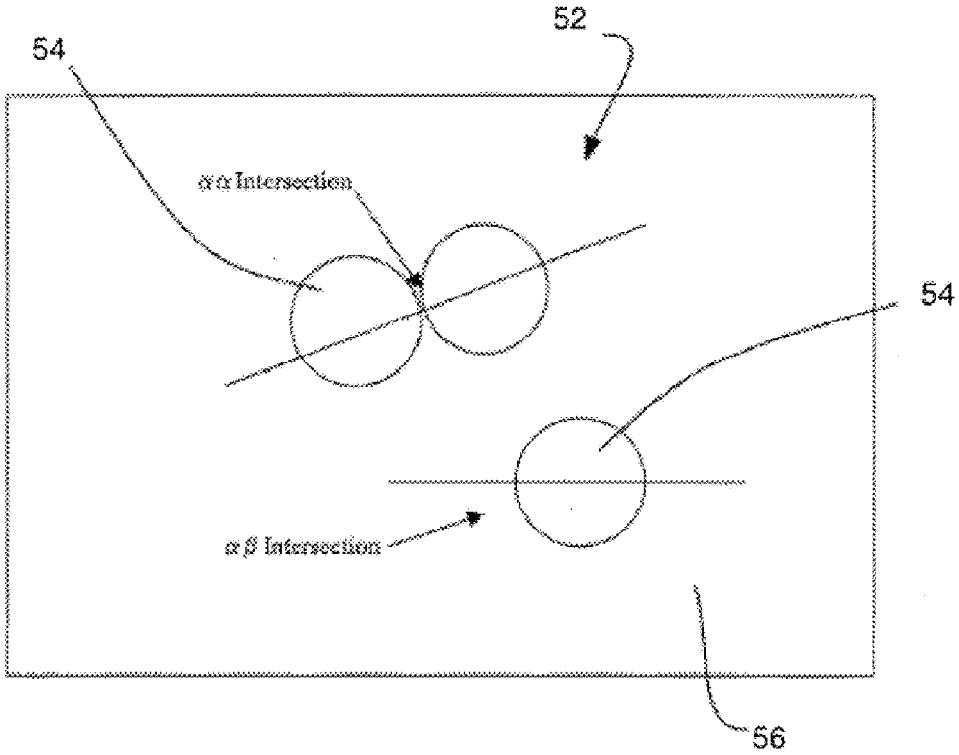
FIG. 6 schematically illustrates the procedure used for determining the contiguity ratios of the dispersed phase of a hybrid cemented carbide.

In certain embodiments of composite tools and blanks according to the present invention, the cemented carbide dispersed (discontinuous) phase of certain hybrid cemented carbides used in the composites has a low contiguity ratio. The degree of dispersed phase contiguity in composite structures may be empirically characterized by the contiguity ratio, $C_t$. $C_t$ may be determined using a quantitative metallography technique described in Underwood, *Quantitative Microscopy,* 279-290 (1968), hereby incorporated herein by reference. The technique used to measure $C_t$ is fully disclosed in the '443 patent, which is incorporated herein in its entirety. As will be known to those having ordinary skill in the art, the technique consists of determining the number of intersections that randomly oriented lines of known length, placed on a photomicrograph of the microstructure of the material, make with specific structural features. The total number of intersections made by the lines with dispersed phase/dispersed phase intersections are counted ($N_{L\alpha\alpha}$), as are the number of intersections with dispersed phase/continuous phase interfaces ($N_{L\alpha\beta}$). FIG. 6 schematically illustrates the procedure through which the values for $N_{L\alpha\alpha}$ and $N_{L\alpha\beta}$ are obtained. In FIG. 6, 52 generally designates a composite including the dispersed phase 54 of a phase in a continuous β phase 56. The contiguity ratio, $C_t$, is calculated by the equation $C_t=2\,N_{L\alpha\alpha}/(N_{L\alpha\beta}+2\,N_{L\alpha\alpha})$.

The contiguity ratio is a measure of the average fraction of the surface area of discontinuous (dispersed) phase regions in contact with other discontinuous (dispersed) phase regions. The ratio may vary from 0 to 1 as the distribution of the dispersed regions changes from completely dispersed ($C_t=0$) to a fully agglomerated structure ($C_t=1$). The contiguity ratio describes the degree of continuity of the dispersed phase irrespective of the volume fraction or size of the dispersed phase regions. However, typically, for higher volume fractions of the dispersed phase, the contiguity ratio of the dispersed phase will also likely be higher.

In the case of hybrid cemented carbides having a hard cemented carbide dispersed phase, the lower the contiguity ratio of the dispersed phase, the lower the likelihood that a crack will propagate through contiguous hard phase regions. This cracking process may be a repetitive one, with cumulative effects resulting in a reduction in the overall toughness of the composite cemented carbide rotary tool. In an embodiment of a composite cemented carbide rotary cutting tool or rotary cutting tool blank according to the present invention, a hybrid cemented carbide included in a region of the tool or blank may include a cemented carbide dispersed phase having a contiguity ratio no greater than 0.48 as measured by the technique described above.

In certain embodiments of a composite cemented carbide rotary cutting tool or rotary cutting tool blank according to the present invention, a hybrid cemented carbide included in a region of the composite may comprise between about 2 to about 40 volume percent of the cemented carbide grade of the dispersed phase. In another embodiment, the cemented carbide dispersed phase may be between 2 and 50 percent of the volume of the hybrid cemented carbide. In other embodiments, the cemented carbide dispersed phase may be between 2 and 30 percent of the volume of the hybrid cemented carbide. In still further embodiments, it may be desirable for the cemented carbide dispersed phase of the hybrid cemented carbide to comprise between 6 and 25 percent of the volume of the hybrid cemented carbide.

In an embodiment, the cemented carbide in the first region 31 and the cemented carbide in the second region 32, including the dispersed cemented carbide phase and the continuous cemented carbide phase of the hybrid cemented carbide, may include a ceramic component composed of carbides of one or more elements belonging to groups IVB through VIB of the periodic table.

The ceramic component preferably comprises about 60 to about 98 weight percent of the total weight of the cemented carbide in each region. Particles of the ceramic component are embedded within a matrix of metallic binder material that preferably comprises about 2 to about 40 weight percent of the total cemented carbide in each region. The binder preferably is one or more of Co, a Co alloy, Ni, a Ni alloy, Fe, and an Fe alloy. The binder optionally also may include, for example, elements such as W, Cr, Ti, Ta, V, Mo, Nb, Zr, Hf, and C in concentrations up to the solubility limits of these elements in the binder. Additionally, the binder may include up to 5 weight percent of elements such as Cu, Mn, Ag, Al, and Ru. In one embodiment of a composite rotary cutting tool or rotary cutting tool blank, the binder of the first cemented carbide and the binder of the second cemented carbide may independently further comprise at least one alloying agent selected from the group consisting of tungsten, chromium, molybdenum, carbon, boron, silicon, copper, manganese, ruthenium, aluminum, and silver. One skilled in the art will recognize that any or all of the constituents of the cemented carbide may be introduced in elemental form, as compounds, and/or as master alloys. The properties of the cemented carbides used in embodiments of the present disclosure may be tailored for specific applications by varying one or any combination of the chemical composition of the ceramic component, the particle size of the ceramic component, the chemical composition of the binder, and the weight ratio of the binder content to the ceramic component content.

In certain embodiments, at least one of the dispersed phase and the continuous phase of a hybrid cemented carbide included in a region of a composite article disclosed herein comprises at least 0.5 percent by weight of cubic carbide based on the total weight of the phase of the hybrid cemented carbide that includes the cubic carbide, or put otherwise, based on the weight of the phase comprising the cubic carbide. In certain other embodiments, at least one of the dispersed phase and the continuous phase of a hybrid cemented carbide included in a region of a composite article disclosed herein comprises at least 1.0 percent by weight of cubic carbide based on the weight of the phase of the hybrid cemented carbide comprising the cubic carbide. In an embodiment, at least one of the dispersed phase and the continuous phase of the hybrid cemented carbide comprises 5 percent or more of cubic carbide based on the total weight of the phase including the cubic carbide. In still other embodiments, at least one of the dispersed phase and the continuous phase of a hybrid cemented carbide comprises 0.5 to 30 percent, 1 to 25 percent, 5 to 25 percent, or about 6 percent by weight of cubic carbide based on the total weight of the phase of the hybrid cemented carbide including the cubic carbide.

As used herein, "cubic carbide" refers to a transition metal carbide that has a cubic-close packed crystal structure. Such a crystal structure also is variously referred to as a face-centered cubic lattice, and as a rock salt crystal structure having a cF8 Pearson Symbol and a B1 Strukturbericht designation. In an embodiment, the cubic carbide content of the hybrid cemented carbide in a region of a composite article according to the present invention may include carbides of one or more transition metals selected from Groups IV and V of the Periodic Table of the Elements. In another embodiment, the cubic carbide content may include one or more of TiC, TaC, NbC, VC, HfC, and ZrC. In yet another embodiment, the cubic carbide content may include one or more of TiC, TaC, and NbC. In still another embodiment, the cubic carbide content may include TiC. In yet another embodiment, the cubic carbide content may comprise solid state solutions of various cubic carbides.

As indicated above, in embodiments of the present invention, a composite cemented carbide rotary cutting tool or rotary cutting tool blank may include at least a first region and a second region. The first region of the composite rotary cutting tool or blank comprises a first cemented carbide that is autogenously bonded to a second region which comprises a second cemented carbide. In embodiments, at least one of the first cemented carbide and the second cemented carbide comprises a hybrid cemented carbide comprising at least 0.5 percent by weight of cubic carbide based on the weight of the phase of the hybrid cemented carbide that includes the cubic carbide. In another embodiment, the first region may be substantially free of cubic carbide and the second region comprises a hybrid cemented carbide including at least 0.5 percent cubic carbide by weight of the phase containing the cubic carbide. In yet another embodiment, more than one region of the composite rotary cutting tool or blank may comprise hybrid cemented carbide including at least 0.5 percent cubic carbide by weight, each cubic carbide content based on the weight of the phase of the hybrid cemented carbide comprising the cubic carbide.

As discussed above, hybrid cemented carbides include a dispersed phase of a first grade of cemented carbide and a continuous phase of a second grade of cemented carbide. In an embodiment of a composite cemented carbide rotary cutting tool or rotary cutting tool blank herein comprising a region including a hybrid cemented carbide including at least 0.5% cubic carbide by weight of the phase comprising the cubic carbide, substantially all of the cubic carbide of the hybrid cemented carbide may be located in the continuous phase of the hybrid cemented carbide. In another embodiment, substantially all of the cubic carbide of the hybrid cemented carbide may be located in the discontinuous (dispersed) phase of the hybrid cemented carbide. In yet another embodiment, both the dispersed phase and the continuous phase of the hybrid cemented carbide include at least 0.5% by weight cubic carbide based on the weight of each individual phase. With respect to a region of a composite cemented carbide rotary cutting tool or blank of the present invention including a hybrid cemented carbide comprising at least 0.5% cubic carbide by weight of the phase comprising the cubic carbide, the composition and/or the properties of the hybrid cemented carbide can be tailored as desired to provide the composite cemented carbide rotary cutting tool or blank with desired mechanical properties.

It is known in the art that the presence of cubic carbide in a cemented carbide results in moderate reduction in strength of the cemented carbide. Also, as indicated above, the strongest cemented carbide grades, which are based on WC and Co, may not be suitable for machining steels. This is because steels typically form long continuous chips during machining, and the chips contact the cemented carbide of the tool. The iron in the steel is a potent carbide forming element, and contact between the machining chips and the carbide causes WC from the tool to diffuse into the surfaces of the steel chips and chemically interact with the iron. Migration of WC from cemented carbide cutting tools weakens the tools and causes the formation of craters on the tools' cutting surfaces. The addition of cubic carbide to the cemented carbide tools alleviates carbide migration and the cratering effect, but does result in a moderate reduction in strength of the tool. However, as taught herein, the strength decrease due to the presence of cubic carbide in the tool can be minimized by including hybrid cemented carbide in the tool and disposing all or a portion of the cubic carbide in the hybrid cemented carbide microstructure. By including at least 0.5% by weight of cubic carbide in a phase of a hybrid cemented carbide microstructure, the chemical wear resistance of a rotary cutting tool may be improved, without significantly reducing tool strength as compared with a rotary cutting tool based on cemented carbides including only tungsten carbide hard particles as the dispersed phase.

By disposing cubic carbide in the hybrid cemented carbide of the tool, reductions in strength of the tool will be minimized and cratering of the tool when used for machining steel will be reduced. Although the embodiments of a composite rotary cutting tool presented herein have a limited number of regions including cemented carbide, it will be understood that the present rotary cutting tools may include any number of regions of cemented carbide, including regions comprising hybrid cemented carbides including cubic carbide, and each region may be formulated with desired properties.

Again referring to FIGS. 3(*a*) and (*b*), the first or core region 31 of the rotary cutting tool blank 30 may be autogenously bonded to the second or outer region 32 at an interface 33. The interface 33 is shown in FIGS. 3(*a*) and (*b*) to be cylindrical, but it will be understood that the shapes of the interfaces of cemented carbide regions in the composite rotary cutting tools and blanks of the present invention are not limited to cylindrical configurations. The autogenous bond between the regions 31 and 32 at the interface 33 may be formed by, for example, a matrix of binder that extends in three dimensions from the core region 31 to the outer region 32, or vice versa. The ratio of binder to ceramic component in the two regions may be the same or different, may be varied between the regions to affect the regions' relative characteristics, and may be varied between the continuous and dispersed phases of the hybrid cemented carbide. By way of example only, the ratio of binder to ceramic component (dispersed phase) in the adjacent regions of the composite tool blank 30 may differ by 1 to 10 weight percent. The characteristics of the cemented carbides in the different regions of the composite rotary cutting tools and tool blanks of the present invention may be tailored to particular applications.

One skilled in the art, after having considered the present description of the invention, will understand that the improved rotary cutting tools and tool blanks of the present invention could be constructed with several regions or layers of different cemented carbides to produce a step-wise progression in the magnitude of one or more properties from a central region of the tool to its periphery. Thus, for example, a twist drill may be provided with multiple coaxially disposed regions of cemented carbide and wherein each such region has successively greater hardness and/or chemical wear resistance than the adjacent, more centrally disposed region. In one embodiment, at least a first or outer region of a composite rotary cutting tool or tool blank may comprise a hybrid cemented carbide including at least 0.5 percent by weight of cubic carbide based on the weight of the phase of the hybrid cemented carbide comprising the cubic carbide, while the inner regions may include a conventional non-hybrid cemented carbide based on, for example and without limitation, tungsten carbide particles dispersed in a continuous cobalt binder. Alternately, non-limiting embodiments of rotary cutting tools and tool blanks disclosed herein could be designed with other composite configurations, wherein different regions of the tool or blank differ with respect to a particular characteristic. Non-limiting examples of alternate configurations are shown in FIGS. 3(*c*) and 3(*d*). It is recognized that specialty drill types, such as, but not limited to, step drills and subland drills will benefit from a composite construction according to the present invention, which is exemplified by the non-limiting twist drill construction disclosed herein.

FIG. 3(*c*) represents an embodiment of the present disclosure that is particularly useful as a cylindrical blank from which drills used for drilling casehardened materials may be produced. For drilling casehardened materials, the drill tip is typically used to penetrate the case, while the body of the drill removes material from the softer core. In this non-limiting embodiment, the first region 34 and the second region 35 are disposed at first and second ends of the blank. The first end would become a tip end of the drill, and the second end would become the end adapted to be secured in the chuck of a machine tool. For machining steel, in an embodiment, the first region 34 may comprise a hybrid cemented carbide comprising at least 0.5 percent by weight of cubic carbide based on the total weight of the phase of the hybrid cemented carbide including the cubic carbide. The presence of cubic carbide improves chemical wear resistance of the drill when used to drill steel workpieces. The at least 0.5 percent by weight of cubic carbide may be present in the dispersed and/or continuous phase of the hybrid cemented carbide included in the first region 34.

Referring again to FIG. 3(*c*), in one embodiment of a composite rotary cutting tool or blank according to the present invention, the at least 0.5 percent by weight of cubic carbide is included in the dispersed phase of a hybrid cemented carbide included in the first region 34. The continuous phase of the hybrid cemented carbide included in first region 34 includes a hard and mechanically wear resistant cemented carbide such as, for example, tungsten carbide particles having an average particle size of 0.3 to 1.5 μm, dispersed in a cobalt alloy binder. In that embodiment, the cobalt alloy binder comprises approximately 6 to 15 weight percent of the continuous phase of the hybrid cemented carbide in the first region 34. The second region 35 of the blank may include a conventional non-hybrid cemented carbide composed of, for example, tungsten carbide particles (1.0 to 10 μm average particle size) in a cobalt alloy binder, wherein the binder comprises approximately 2 to 6 weight percent of the conventional non-hybrid cemented carbide in the second region 35. The first region 34 is autogenously bonded to the second region 35. The second region 35 has an enhanced modulus of elasticity relative to the first region 34 so as to resist flexing when pressure is applied to a drill fabricated from the blank shown in FIG. 3(*c*).

The embodiment shown in FIG. 3(*d*) combines features of the embodiments of FIGS. 3(*a*) and 3(*c*). The cutting tip 36 includes two regions, a core region 37 and an outer region 38, wherein each region comprises a different grade of cemented carbide. The core and outer regions 37 and 38 are coaxially disposed and autogenously bonded to a third region 39. Region 38 may be compositionally similar to region 34 of the blank shown in FIG. 3(*c*) and includes a hybrid cemented carbide including at least 0.5% cubic carbide by weight based on the weight of the phase that includes the cubic carbide, to reduce cratering when a tool made from the blank is used to machine steel. Because the cubic carbide content is disposed in a hybrid cemented carbide, however, the presence of the cubic carbide does not significantly reduce the strength or mechanical wear resistance of a rotary cutting tool made from the tool blank. Region 37 may include a conventional non-hybrid grade cemented carbide providing high strength and which comprises, for example, tungsten carbide particles (e.g., 0.3 to 1.5 μm average particle size) in a cobalt alloy binder, wherein the binder comprises approximately 6 to 15 weight percent of the cemented carbide in the core region 37. Region 39 may have a composition similar to region 35 of FIG. 3(*c*) so as to resist flexing when pressure is applied to a drilling tool made from the tool blank.

In an embodiment, a composite article according to the present invention may include a region that comprises at least one conventional non-hybrid cemented carbide, and a region that comprises at least one hybrid cemented carbide including a cemented carbide dispersed phase and a cemented carbide continuous phase. As long as one phase of a hybrid cemented carbide of the composite article comprises at least 0.5% cubic carbide by weight of the phase, each non-hybrid cemented carbide, as well as each cemented carbide dispersed and continuous phase of the hybrid cemented carbide of the composite article, may independently comprise: at least one transition metal carbide selected from the group consisting of titanium carbide, chromium carbide, vanadium carbide, zirconium carbide, hafnium carbide, tantalum carbide, molybdenum carbide, niobium carbide, and tungsten carbide; and a binder comprising at least one material selected from the group consisting of cobalt, a cobalt alloy, nickel, a nickel alloy, iron, and an iron alloy. In an embodiment of the composite article, the at least one transition metal carbide comprises tungsten carbide. In other embodiments, the tungsten carbide has an average particle size of 0.3 to 10 micrometers. In yet other embodiments, one or more of the various binder phases of the composite article comprise at least one alloying agent selected from the group consisting of tungsten, chromium, molybdenum, carbon, boron, silicon, copper, manganese, ruthenium, aluminum, and silver. In still other embodiments of a composite article according to the present invention, the conventional non-hybrid cemented carbide grade, the cemented carbide dispersed phase of the hybrid cemented carbide, and the cemented carbide continuous phase of the hybrid cemented carbide each individually comprise 2 to 40 percent by weight of binder and 60 to 98 percent by weight of metal carbide.

In an embodiment of a composite article disclosed herein, at least one of the first region and the second region is substantially free of cubic carbide, whereas the other of the first region and the second region comprises a hybrid cemented carbide comprising at least 0.5% cubic carbide by weight based on the weight of the phase of the hybrid cemented carbide including the cubic carbide. In other embodiments, substantially all of the cubic carbide in the hybrid cemented carbide is included in the cemented carbide dispersed phase of the hybrid cemented carbide. In yet other embodiments, substantially all of the cubic carbide in the hybrid cemented carbide is included in the cemented carbide continuous phase of the hybrid cemented carbide. In still other embodiments, cubic carbide may be included in both the continuous and the dispersed phase of the hybrid cemented carbide, both in a concentration of at least 0.5% based on the weight of each individual phase of the hybrid cemented carbide.

An advantage of the composite cemented carbide rotary cutting tools and tool blanks of the present disclosure is the flexibility available to tailor properties of regions of the tools and blanks to suit different applications. Another advantage is the reduced chemical wear and/or cratering that results from the presence in the composite articles of a hybrid cemented carbide including at least 0.5 weight percent cubic carbide. The reduced chemical wear and/or cratering is achieved when tools according to the present invention are used to machine steels. Also, disposing all or substantially all of the cubic carbide in a hybrid cemented carbide does not significantly reduce the strength or mechanical wear resistance of the tools. The thickness, geometry, and/or physical properties of the individual cemented carbide regions of a particular composite blank of the present invention may be selected to suit the specific application of the rotary cutting tool fabricated from the blank. Thus, for example, the modulus of elasticity of one or more cemented carbide regions of the rotary cutting tool experiencing significant bending during use may be increased; the hardness and/or mechanical wear resistance of one or more cemented carbide regions having cutting surfaces and that experience cutting speeds greater than other cutting edge regions may be increased; and/or the chemical wear resistance of regions of cemented carbide subject to chemical wear during use may be enhanced.

Figure 1B:
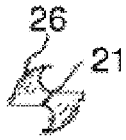
Figure 2B:
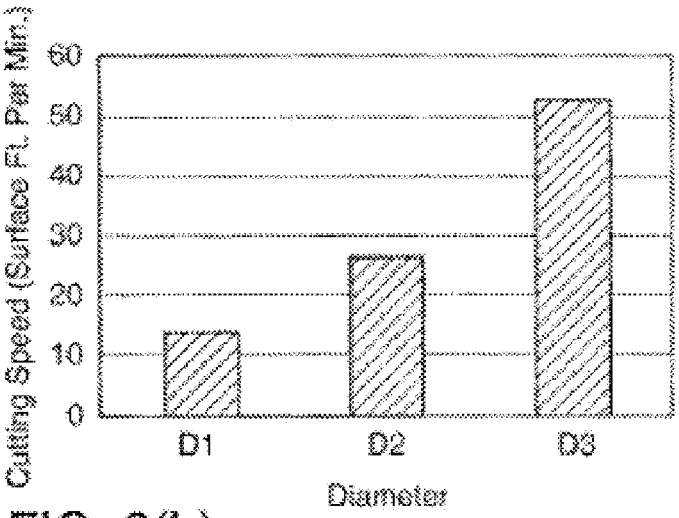
FIG. 2(*a*) is a schematic depicting three diameters D1, D2, and D3 along the cutting edge of a conventional non-hybrid twist drill.
Figure 2A:
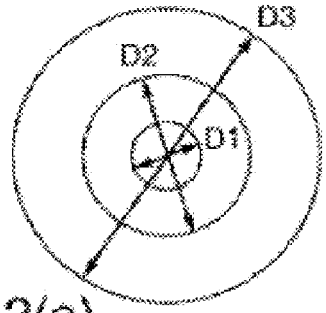
Figure 3A:
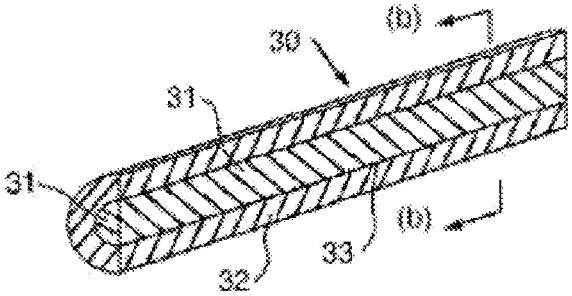
FIGS. 3(*a*)-(*d*) are cross-sectional views of novel blanks useful for producing composite rotary cutting tools constructed according to the present invention, wherein FIGS. 3(*a*) and 3(*b*) depict a first embodiment, and FIG. 3(*b*) is a cross-sectional end view of the blank shown in perspective in FIG. 3(*a*)
Figure 3B:
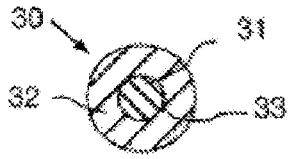
Figure 3C:
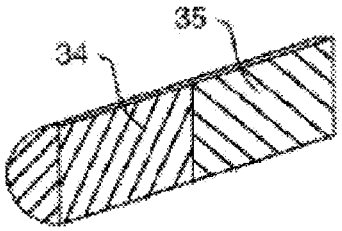
Figure 3D:
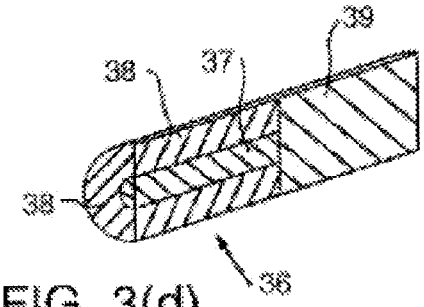

Referring now to the non-limiting example of a twist drill depicted in FIG. 1, a rotary cutting tool or rotary cutting tool blank 20 may comprise an elongate portion 22. In a non-limiting embodiment, the elongate portion 22 may define a cutting edge 25. In a further non-limiting embodiment, a cutting edge 25 on the elongate portion 22 may be helically oriented about a surface 28 of the elongate portion.

One non-limiting embodiment of a composite cemented carbide rotary cutting tool or rotary cutting tool blank according to this disclosure includes an elongate portion in which one of the first region and the second region is a core region and the other of the first region and the second region is an outer region, and wherein the first and second regions are coaxially disposed. In an embodiment, the outer region may comprise a hybrid cemented carbide comprising at least 0.5% by weight of cubic carbide based on the total weight of the phase of the hybrid cemented carbide that includes the cubic carbide. In another embodiment, the first region may cover at least a portion of the second region, and the first region may include the hybrid cemented carbide comprising at least 0.5 weight percent cubic carbide in relation to the total weight of the phase of the hybrid cemented carbide including the cubic carbide.

In certain embodiments wherein the composite cemented carbide rotary cutting tool is to be used to machine steel, the outer region of a rotary cutting tool may comprise a hybrid cemented carbide microstructure comprising at least 0.5 percent by weight of cubic carbide based on the total weight of the phase of the hybrid cemented carbide comprising the cubic carbide. In a non-limiting embodiment wherein the outer region comprises a hybrid cemented carbide microstructure comprising at least 0.5 percent by weight of cubic carbide, the inner region may be a conventional non-hybrid grade of cemented carbide that is substantially free of cubic carbide. In an embodiment, a conventional non-hybrid grade of cemented carbide that either includes cubic carbide or, alternatively, is substantially free of cubic carbide may be a grade including tungsten carbide hard particles dispersed in a cobalt binder. It will be understood, however, that the use of any other conventional non-hybrid grade of cemented carbide is within the scope of the claims of this disclosure and could be selected by the skilled practitioner to achieve specific properties in each region of a rotary cutting tool or rotary cutting tool blank according to the present disclosure. In any such embodiment, however, at least one region of the tool or blank includes a hybrid cemented carbide comprising at least 0.5 weight percent cubic carbide in the continuous and/or dispersed phase of the hybrid cemented carbide based on the weight of the particular phase comprising the cubic carbide.

As noted above, the composite cemented carbide rotary cutting tools and rotary cutting tool blanks embodied in this disclosure include an elongate portion. Such tools and blanks include, but are not limited to, a drill, a drill blank, an end mill, an end mill blank, a tap, and a tap blank. In certain embodiments, one of a drill, a drill blank, an end mill, an end mill blank, a tap, and a tap blank may include a first cemented carbide in a first region and second cemented carbide in a second region. At least one of the first cemented carbide and the second cemented carbide is a hybrid cemented carbide. The hybrid cemented carbide comprises a cemented carbide discontinuous phase and a cemented carbide continuous phase, wherein at least one of the cemented carbide discontinuous phase and the cemented carbide continuous phase of the hybrid cemented carbide comprises at least 0.5 percent by weight of cubic carbide based on the total weight of the phase containing the cubic carbide, and wherein the chemical wear resistance of the first cemented carbide differs from the second cemented carbide.

With regard to the property of chemical wear resistance, chemical wear is often referred to as corrosive wear, which is defined as "wear in which chemical or electrochemical reaction with the environment is significant." See *ASM Materials Engineering Dictionary*, J. R. Davis, Ed., ASM International, Fifth printing (January 2006) p. 98. During machining of steel using conventional non-hybrid cemented carbide rotary cutting tools based on tungsten carbide and cobalt, chemical wear of the tool occurs because the WC has a tendency to diffuse into the steel machining chips that contact the tool, and the carbide reacts with the iron in the steel (iron is a carbide former). Incorporation of cubic carbide in the hybrid microstructure of a hybrid cemented carbide that is included in at least one of the first and the second regions of the composite cemented carbide tools and blanks disclosed herein reduces chemical wear of the tool, reducing or eliminating cratering of the tool when used to machine steel. Because the cubic carbide content is present in a hybrid cemented carbide microstructure, however, the strength of the tool does not significantly decrease.

While not wanting to be held to any particular scientific theory, it is believed that the addition of at least 0.5% cubic carbide based on the weight of the phase including the cubic carbide reduces or eliminates cratering by changing the stability of tungsten carbide towards iron. Titanium and tantalum are stronger carbide formers than tungsten. Iron in the steel alloy is also a carbide former. When a rotary tool with a cemented carbide grade comprising only tungsten carbide is used to drill or machine steel, the iron interacts with the tungsten carbide to form an iron carbide, with resulting cratering of the tool. It is believed that cubic carbides change the stability of tungsten carbide in relation to the iron by alloying with the tungsten carbide. The iron has less tendency to react with the tungsten carbide alloyed with the cubic carbides, even at the low levels of embodiments of this disclosure, and cratering of the composite rotary tool disclosed herein is subsequently reduced or eliminated.

In addition, when cubic carbide is present in the hybrid microstructure of the cemented carbide of a rotary tool disclosed herein, the reduction of strength of the composite rotary tool is minimal. In a non-limiting embodiment, when the cubic carbide is present in the dispersed phase of the hybrid cemented carbide, the reduction of strength of the tool is minimized as compared to a prior art rotary tool comprising cubic carbide in a non-hybrid cemented carbide grade. It is understood, however, that the reduction of strength of a composite rotary tool comprising cubic carbide in a hybrid cemented carbide microstructure of embodiments disclosed herein is minimal when the cubic carbide is present in either the dispersed phase, the continuous phase, or both phases of the hybrid cemented carbide, and that the location of the cubic carbide in the hybrid microstructure is dependent on the desired properties in locations of the composite rotary tool. The design parameters to achieve the localized properties in embodiments of a composite rotary tool disclosed herein would be known by a person having ordinary skill in the art, or could be determined by a person having ordinary skill in the art without undue experimentation, after having considered the present description of the invention.

Embodiments of composite rotary cutting tools and tool blanks according to the present disclosure may be made by any suitable process known in the art, but preferably are made using a dry bag isostatic method as further described below. The dry bag process is particularly suitable because it allows the fabrication of composite rotary cutting tools and tool blanks with many different configurations, non-limiting examples of which have been provided in FIGS. 3(*a*)-(*d*). The configurations shown in FIGS. 3(*c*) and (*d*) would be extremely difficult, if not impossible, to produce using other powder consolidation techniques such as die compaction, extrusion, and wet bag isostatic pressing.

In an embodiment of a method according to the present disclosure for producing composite rotary cutting tools, a hybrid cemented carbide blend is prepared. A method of preparing a hybrid cemented carbide blend may include mixing at least one of partially or fully sintered granules of a first cemented carbide grade, which serves as the dispersed grade in the hybrid cemented carbide portion of the sintered compact, with at least one of green and unsintered granules of a second cemented carbide grade, which serves as the continuous phase of the hybrid cemented carbide portion of the sintered compact. At least one of the first cemented carbide grade and the second cemented carbide grade used to form the hybrid cemented carbide comprises at least 0.5 percent by weight of cubic carbide, as disclosed hereinabove, based on the total weight of the components of the cemented carbide grade including the cubic carbide.

In another embodiment, at least one of the first cemented carbide grade and the second cemented carbide grade of the hybrid cemented carbide comprises at least 1.0 percent by weight of cubic carbide, base on the total weight of the components of the carbide grade including the cubic carbide. The hybrid cemented carbide blend is placed into a first region of a void of a mold. A metallurgical powder may be placed into a second region of the void, wherein at least a portion of the hybrid cemented carbide blend contacts the metallurgical powder. The metallurgical powder may be a cemented carbide powder blend comprising hard particles such as, but not limited to, tungsten carbide particles, blended with metallic binder particles or powders, such as, but not limited to, a cobalt or cobalt alloy powder. The hybrid cemented carbide blend and the metallurgical powder may be consolidated to form a compact, and the compact may be sintered using conventional means. In a non-limiting embodiment, the compact is sintered using over-pressure sintering.

Partial or full sintering of the granules used as the dispersed phase of the hybrid cemented carbide results in strengthening of the granules (as compared to "green" granules). The strengthened granules of the dispersed phase will have an increased resistance to collapse during consolidation of the blend into a compact. The granules of the dispersed phase may be partially or fully sintered at temperatures ranging from about 400° C. to about 1300° C., depending on the desired strength of the dispersed phase. The granules may be sintered by a variety of means, such as, but not limited to, hydrogen sintering and vacuum sintering. Sintering of the granules may cause removal of lubricant, oxide reduction, densification, and microstructure development. Partial or full sintering of the dispersed phase granules prior to blending results in a reduction in the collapse of the dispersed phase during blend consolidation. Embodiments of this method of producing hybrid cemented carbides allow for forming hybrid cemented carbides with lower dispersed phase contiguity ratios. When the granules of at least one cemented carbide are partially or fully sintered prior to blending, the sintered granules do not collapse during the consolidation after blending, and the contiguity of the resultant hybrid cemented carbide is relatively low. Generally speaking, the larger the dispersed phase cemented carbide granule size and the smaller the continuous cemented carbide phase granule size, the lower the contiguity ratio at any volume fraction of the hard grade.

In one non-limiting embodiment, a method of forming a composite cemented carbide rotary cutting tool or tool blank includes placing a hybrid cemented carbide blend containing at least 0.5 percent cubic carbide (based on the total weight of the phase of the hybrid cemented carbide including the cubic carbide) into a first region of a mold. The mold may be, for example, a dry-bag rubber mold. A metallurgical powder used to form a conventional cemented carbide may be placed into a second region of the void of the mold. Depending on the number of regions of different cemented carbides desired in the rotary cutting tool, the mold may be partitioned into additional regions in which particular metallurgical powders and/or hybrid cemented carbide blends containing at least 0.5 percent cubic carbide by weight of the phase containing the cubic carbide are disposed. It will be understood that in order to obtain other characteristics, hybrid cemented carbides that do not contain cubic carbides may be included in the mold and incorporated in the tool or tool blank, as long as one region of the rotary cutting tool or rotary cutting tool blank comprises a hybrid cemented carbide including at least 0.5 percent cubic carbide by weight of the phase of the hybrid cemented carbide including the cubic carbide. The mold may be segregated into regions by placing a physical partition in the void of the mold to define the two or more regions. The hybrid cemented carbide blend or blends include a phase comprising at least 0.5 percent cubic carbide, and the one or more metallurgical powders included in the various regions of the mold are chosen to achieve the desired properties of the corresponding regions of the rotary cutting tool, as described above. A portion of the materials in the first region and the second region are brought into contact with each other, and the mold is isostatically compressed to densify the metallurgical powders to form a compact of consolidated powders. The compact is then sintered to further densify the compact, consolidate the powders, and form an autogenous bond between the first, second, and, if present, other regions. The sintered compact provides a blank that may be machined to include a cutting edge and/or other physical features of the geometry of a particular rotary cutting tool. Such features are known to those of ordinary skill in the art and are not specifically described herein.

In one non-limiting embodiment, after the step of over-pressure sintering the compact, the compact comprises a hybrid cemented carbide comprising a cemented carbide dispersed phase and a cemented carbide continuous phase. In an embodiment, the contiguity ratio of the cemented carbide dispersed phase in the hybrid cemented carbide is no greater than 0.48.

In one non-limiting embodiment, after the step of over-pressure sintering the compact, substantially all of the cubic carbide in the hybrid cemented carbide is present in the cemented carbide dispersed phase of the hybrid cemented carbide. In another embodiment, after the step of over-pressure sintering the compact, substantially all of the cubic carbide in the hybrid cemented carbide is present in the cemented carbide continuous phase of the hybrid cemented carbide. In still another embodiment, after the step of over-pressure sintering the compact, the cemented carbide dispersed phase comprises 2 to 50 percent by volume of the hybrid cemented carbide.

In one non-limiting embodiment, the sintered granules of the first cemented carbide grade may be least one of partially sintered granules and fully sintered granules, and preparing the hybrid cemented carbide blend comprises blending materials including 2 to less than 40 percent by volume sintered granules of the first cemented carbide grade and greater than 60 to 98 percent by volume unsintered cemented carbide granules of the second cemented carbide grade, wherein the weight percentages are based on the total weight of the cemented carbide blend. In another embodiment, sintering a blend comprises sintering a metal carbide and a binder to form the sintered granules of the first cemented carbide grade. In one embodiment, sintering the blend may comprise sintering the metal carbide and the binder at 400° C. to 1300° C.

A non-limiting embodiment for preparing a hybrid cemented carbide blend comprises blending materials including 2 to 30 percent by volume of the sintered granules of a first cemented carbide grade and 70 to 98 percent by volume of the unsintered granules of a second cemented carbide grade, wherein the weight percentages are based on the total weight of the cemented carbide blend.

In one non-limiting embodiment of a method disclosed herein, the first cemented carbide grade, the second cemented carbide grade, and the metallurgical powder each independently comprise a metal carbide selected from the group consisting of titanium carbide, chromium carbide, vanadium carbide, zirconium carbide, hafnium carbide, tantalum carbide, molybdenum carbide, niobium carbide, and tungsten carbide, and a binder selected from the group consisting of cobalt, a cobalt alloy, nickel, a nickel alloy, iron, and an iron alloy. Certain embodiments further comprise including at least one alloying agent in the binder, wherein the alloying agent is selected from the group consisting of tungsten, chromium, molybdenum, carbon, boron, silicon, copper, manganese, ruthenium, aluminum, and silver.

A non-limiting method for manufacturing a composite rotary cutting tool according to embodiments disclosed herein may further comprise removing material from the sintered compact (i.e., a blank) to provide at least one cutting edge. A non-limiting embodiment of a method of removing material from the compact may comprise machining the compact to form at least one helically oriented flute defining at least one helically oriented cutting edge. In an embodiment, helical flutes may be formed by grinding using diamond-based grinding wheels known to those having ordinary skill in the art. Other means of producing flutes on a rotary tool, which are known now or hereinafter to a person having ordinary skill in the art, are within the scope of embodiments of a composite rotary tool disclosed herein.

In one non-limiting embodiment of a method of forming a composite article disclosed herein, the mold may comprise a dry-bag rubber mold, and further consolidating the cemented carbide blend and the metallurgical powder to form a compact comprises isostatically compressing the dry-bag rubber mold to form the compact. A non-limiting method embodiment may include physically partitioning the void of the dry-bag rubber mold into at least the first region and the second region. In an embodiment, physically partitioning the void comprises inserting a sleeve into the void to divide the void between the first region and the second region. In certain embodiments, the sleeve is comprised of plastic, metal, or paper. In another non-limiting embodiment at least a portion of the cemented carbide blend is contacted with the metallurgical powder by removing the sleeve from the void after placing the cemented carbide blend and the metallurgical powder into the void of the mold. In another embodiment, contacting at least a portion of the cemented carbide blend with the metallurgical powder comprises placing one of the cemented carbide blend and the metallurgical powder into the void so as to be in contact along an interface with the other of the cemented carbide blend and the metallurgical powder.

In certain embodiments of a method of making an article selected from a composite rotary cutting tool and a composite rotary cutting tool blank, the first cemented carbide grade, the second cemented carbide grade, and the metallurgical powder may each independently comprise 2 to 40 percent by weight of binder and 60 to 98 percent by weight of transition metal carbide. In another embodiment, at least one of the first cemented carbide grade, the second cemented carbide grade, and the metallurgical powder comprises tungsten carbide particles having an average particle size of 0.3 to 10 μm. In these embodiments, at least one of the first cemented carbide grade and the second cemented carbide grade includes at least 0.5% cubic carbide by total weight of the grade.

A non-limiting embodiment may include consolidating the cemented carbide blend and the metallurgical powder to form a compact by isostatically compressing the mold at a pressure of 5,000 to 50,000 psi. In a non-limiting embodiment, over-pressure sintering the compact comprises heating the compact at 1350° C. to 1500° C. under a pressure of 300-2000 psi.

Non-limiting examples of methods of providing composite rotary cutting tools and rotary cutting tool blanks according to the present disclosure follow.

EXAMPLE 1

Figure 7:
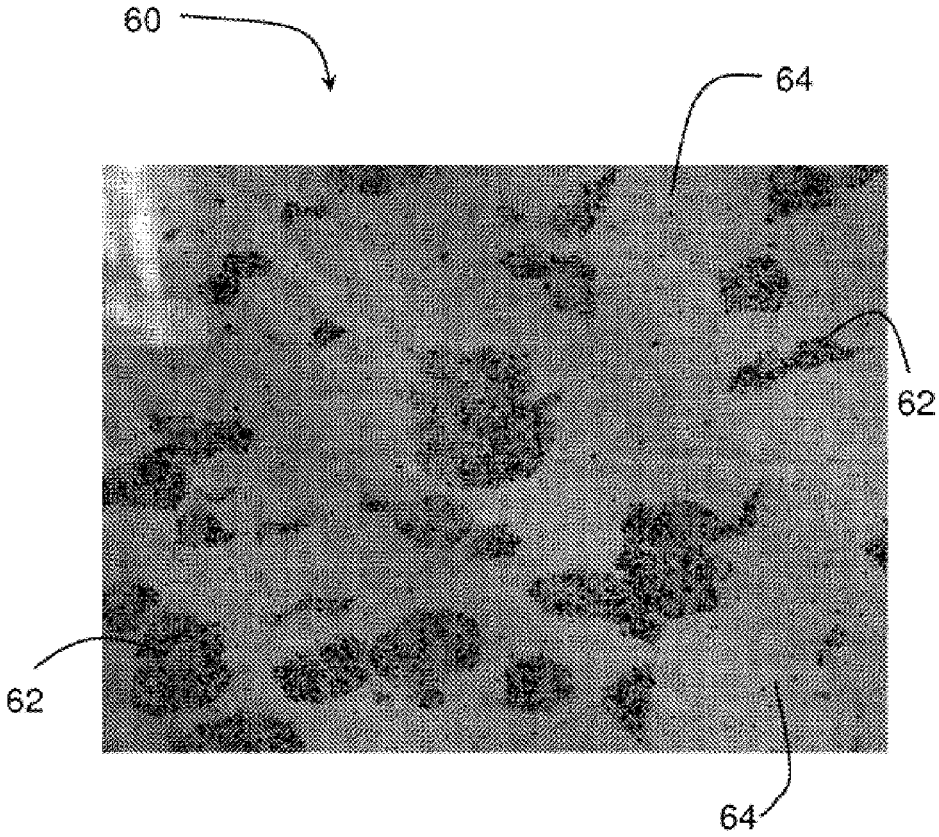
FIG. 7 is a photomicrograph of a hybrid cemented carbide in which the dispersed phase includes cubic carbide and the continuous phase is relatively free of cubic carbide.

FIG. 7 is a micrograph of a region 60 of a rotary tool blank comprising a hybrid cemented carbide including cubic carbide according to the present disclosure. The region depicted in FIG. 7 comprises a hybrid cemented carbide grade including 20 percent by volume of Firth Grade T-04 cemented carbide as the dispersed phase 62. Firth Grade T-04 cemented carbide comprises 6% by weight of a solid solution of the cubic carbides TiC, TaC, and NbC, 82% by weight of WC, and 12% by weight Co. The continuous phase 64 of the hybrid cemented carbide region of the rotary cutting tool blank shown in FIG. 7 comprises 80 percent by volume of Firth Grade 248 cemented carbide. Firth Grade 248 cemented carbide comprises 89% by weight of WC and 11% by weight of Co. The measured contiguity ratio of the dispersed phase 62 is 0.26 and, thus, is less than 0.48. All cemented carbide powders were obtained from ATI Firth Sterling, Madison, Ala.

EXAMPLE 2

The hybrid cemented carbide region 60 of the rotary tool blank depicted in FIG. 7 of Example 1 was prepared by presintering the Firth Grade T-04 cemented carbide granules (or powder) at a temperature of 800° C. in a vacuum. The presintered Firth Grade T-04 cemented carbide granules comprise the dispersed phase 62 of the hybrid cemented carbide region depicted in FIG. 7. The presintered granules were blended with green granules of Firth Grade 248 to form a hybrid cemented carbide blend. The hybrid cemented carbide blend was placed in a void in a mold and compacted at a pressure of 137.9 MPa (20,000 psi) by mechanical pressing. It is understood that isostatic pressing can be used for the same result. The hybrid cemented carbide compact was overpressure sintered in a sinter hot isostatic pressing (sinter-HIP) furnace at 1400° C.

EXAMPLE 3

Figure 8:
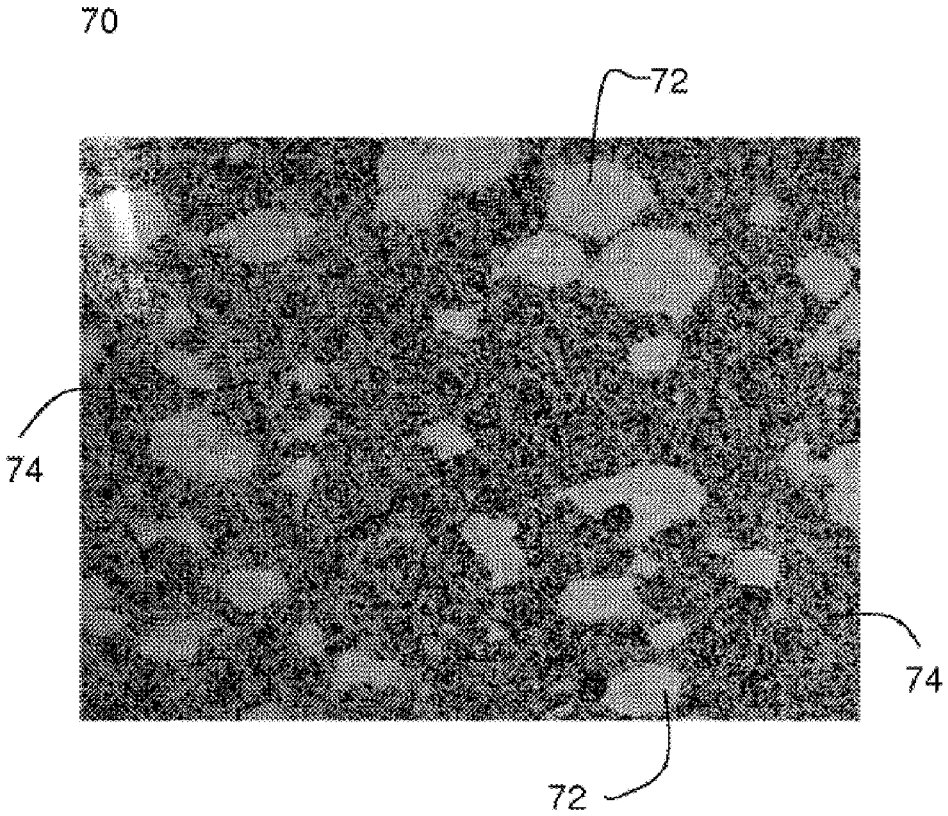
FIG. 8 is a photomicrograph depicting a hybrid cemented carbide in which the dispersed phase is relatively free of cubic carbide and the continuous phase contains cubic carbide.

A region 70 of a tool blank comprising a hybrid cemented carbide comprising cubic carbide according to the present disclosure is seen in the micrograph of FIG. 8. The hybrid cemented carbide shown in FIG. 8 includes 20 percent by volume ATI Firth Sterling Grade 248 cemented carbide as the dispersed phase 72 and 80 percent by volume ATI Firth Sterling Grade T-04 cemented carbide (with 6% by weight cubic carbide) as the continuous phase 74. The contiguity ratio of the dispersed phase is 0.40. The hybrid cemented carbide region of the tool blank was prepared using a process and conditions similar to Example 2.

EXAMPLE 4

Figure 9:
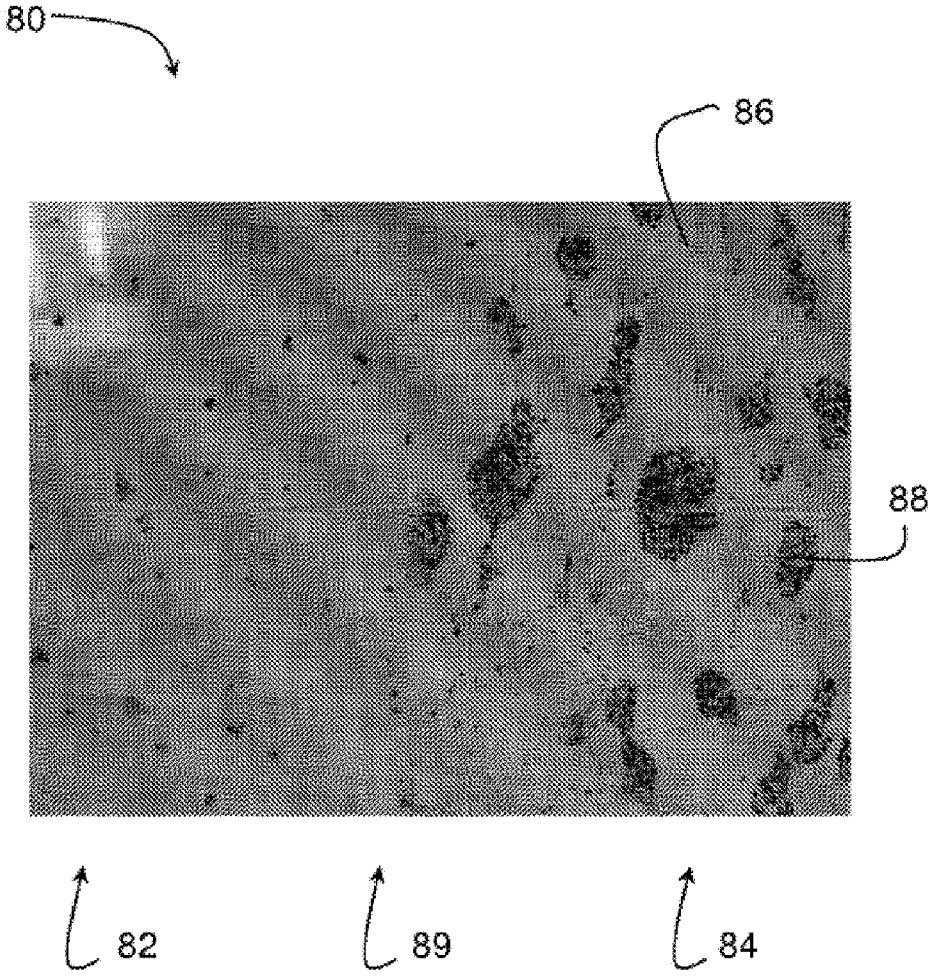
FIG. 9 is a photomicrograph of a section of an embodiment of a composite cemented carbide rotary cutting tool including a first region comprising a conventional non-hybrid cemented carbide, and a second region comprising a hybrid cemented carbide that includes cubic carbide as the dispersed phase.

A hybrid cemented carbide blend and a conventional non-hybrid grade cemented carbide metallurgical powder were placed in separate regions of a void of a mold for producing a rotary cutting tool blank and were in contact along an interface. Conventional non-hybrid compaction and sintering processes, similar to those disclosed in Example 2, were performed to provide a composite cemented carbide rotary cutting tool blank including a first region of a hybrid cemented carbide comprising cubic carbide, and wherein the first region was metallurgically bonded to a second region consisting of a conventional non-hybrid cemented carbide that did not contain any substantial concentration of cubic carbide. The microstructure 80 of the composite cemented carbide is shown in FIG. 9. The Firth Grade 248 cemented carbide is shown on the left hand side of the micrograph, designated as 82. The hybrid cemented carbide is shown on the right hand side of the micrograph, designated as 84. The hybrid cemented carbide included 80 percent by volume Firth Grade 248 cemented carbide as the continuous phase 86, and 20 percent by volume of Firth Grade T-04 cemented carbide including 6% cubic carbide as the dispersed phase 88. An interfacial region 89 is evident in FIG. 9 between the conventional non-hybrid grade microstructure 82 and the hybrid grade microstructure 84.

EXAMPLE 5

Figure 10:
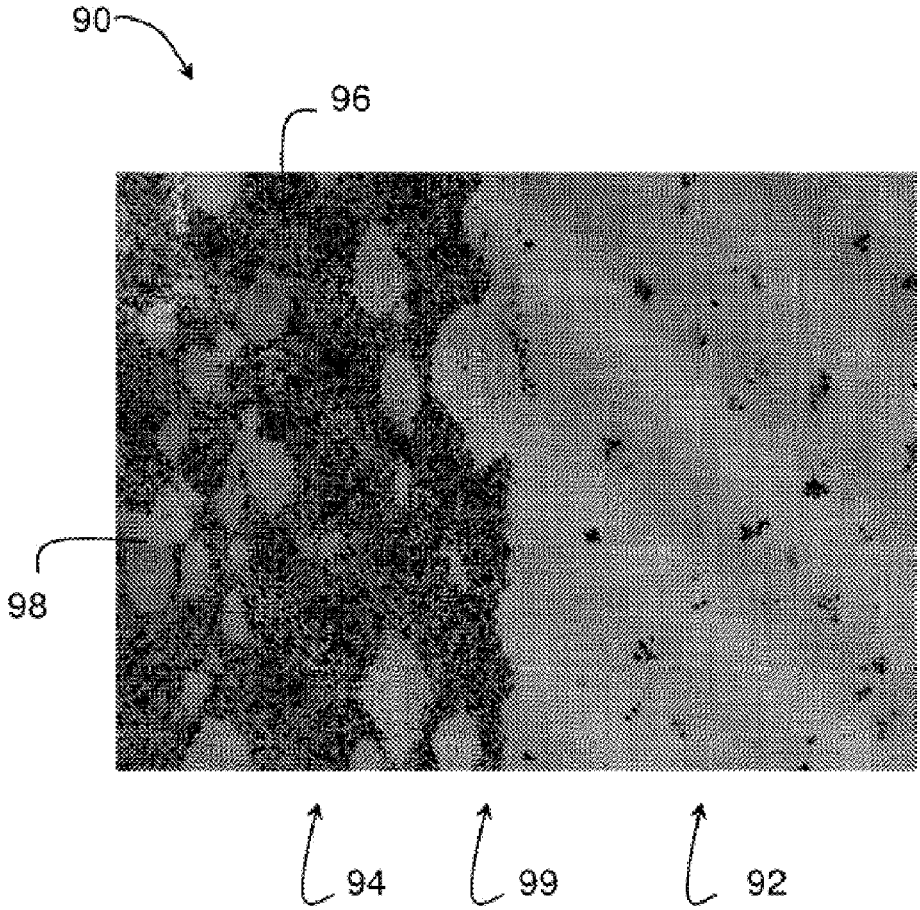
FIG. 10 is a photomicrograph of a section of an embodiment of a composite cemented carbide rotary cutting tool including a first region comprising a hybrid cemented carbide that includes cubic carbide as the continuous phase and a second region comprising a conventional non-hybrid cemented carbide grade.

A hybrid cemented carbide blend and a conventional non-hybrid cemented carbide metallurgical powder were placed in separate regions of a void of a mold adapted for producing a rotary cutting tool blank and were in contact along an interface. Conventional non-hybrid compaction and sintering processes, similar to those disclosed in Example 2, were performed to provide a composite cemented carbide including a first region of a hybrid cemented carbide containing cubic carbide, metallurgically bonded to a second region of a conventional non-hybrid cemented carbide. The microstructure 90 of the composite cemented carbide is shown in FIG. 10. The Firth Grade 248 conventional non-hybrid grade cemented carbide microstructure 92 is seen on the right hand side of the micrograph. A hybrid grade microstructure 94 is seen on the left hand side of the micrograph and includes 20 percent by volume of Firth Grade 248 cemented carbide as the dispersed phase 96 and 80 percent by volume of Firth Grade T-04 cemented carbide as the continuous phase 98. Firth Grade T-04 cemented carbide powder used in preparing the sample comprises a total of 6% by weight of the cubic carbides TiC, TaC, and NbC. An interfacial region 99 between the conventional non-hybrid grade microstructure 92 and the hybrid grade microstructure 94 is evident.

EXAMPLE 6

Figure 11:
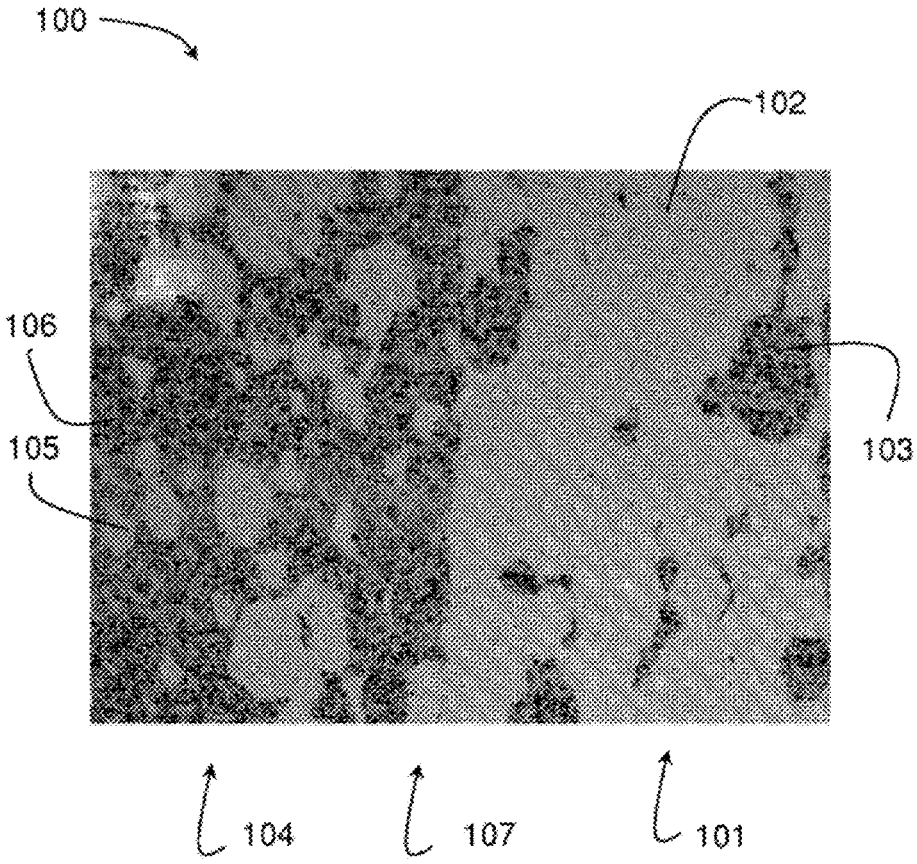
FIG. 11 is a photomicrograph of a section of an embodiment of a composite cemented carbide rotary cutting tool including a first region comprising a hybrid cemented carbide that includes cubic carbide as the continuous phase, and a second region comprising a hybrid cemented carbide that includes cubic carbide as the dispersed phase.

A first hybrid cemented carbide blend and a second hybrid cemented carbide blend were placed in separate regions of the void of a mold for making a composite rotary cutting tool blank and were in contact along an interface. Conventional non-hybrid compaction and sintering processes, similar to those disclosed in Example 2, were performed to provide a composite cemented carbide rotary cutting tool blank including a first region of a hybrid cemented carbide autogenously bonded to a second region of a hybrid cemented carbide. The microstructure 100 of the first and second hybrid cemented carbide regions of the composite cemented carbide rotary cutting tool blank is depicted in FIG. 11. The right hand side of the microstructure 100 is the first hybrid cemented carbide microstructure 101, and the left hand side of the microstructure 100 is the second hybrid cemented carbide microstructure 104. The first hybrid cemented carbide includes 80 percent by volume of Firth Grade 248 cemented carbide as the continuous phase 102 and 20 percent by volume of Firth Grade T-04 cemented carbide, including cubic carbide, as the dispersed phase 103. The second hybrid cemented carbide includes 20 percent by volume of Firth Grade 248 cemented carbide as the dispersed phase 105 and 80 percent by volume of Firth Grade T-04 cemented carbide, including cubic carbide, as the continuous phase 106. An interfacial region 107 between the first hybrid grade cemented carbide microstructure 101 and the second hybrid cemented carbide grade microstructure 104 is evident in FIG. 11.

EXAMPLE 7

Figure 12:
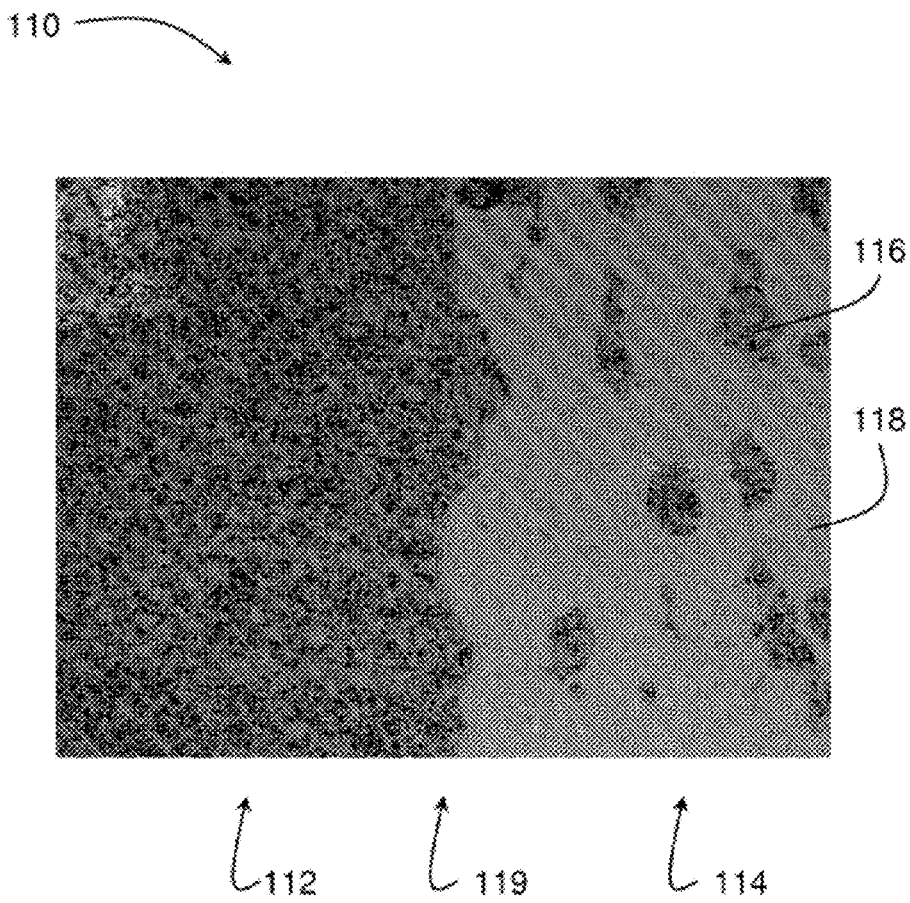
FIG. 12 is a photomicrograph of a section of an embodiment of a cemented carbide rotary cutting tool including a first region comprising a conventional non-hybrid cemented carbide grade based on tungsten carbide, cubic carbide, and cobalt, and a second region comprising a hybrid cemented carbide that includes cubic carbide in the dispersed phase and no substantial cubic carbide content in the continuous phase.

A metallurgical powder and a hybrid cemented carbide blend were placed in separate regions of the void of a mold for making a composite rotary cutting tool blank and were in contact along an interface. Conventional non-hybrid compaction and sintering processes, similar to those disclosed in Example 2, were performed to provide a composite cemented carbide rotary cutting tool blank including a first region including a conventional non-hybrid cemented carbide grade autogenously bonded to a second region including a hybrid cemented carbide. The microstructure 110 of the interface of the conventional non-hybrid cemented carbide grade and hybrid cemented carbide of the composite cemented carbide rotary cutting tool blank is depicted in FIG. 12. The left hand side of the microstructure 110 is the conventional non-hybrid cemented carbide microstructure 112, and the right hand side of the microstructure 110 is the hybrid cemented carbide microstructure 114. The conventional non-hybrid cemented carbide is Grade T-04 cemented carbide, containing 6% by weight of cubic carbide. The hybrid cemented carbide includes 20 percent by volume of Grade T-04 cemented carbide as the dispersed phase 116, and 80 percent by volume of Grade 248 cemented carbide as the continuous phase 118. An interfacial region 119 between the conventional non-hybrid grade microstructure 112 and the hybrid grade microstructure 114 is evident.

It will be understood that the present description illustrates those aspects of the invention relevant to a clear understanding of the invention. Certain aspects that would be apparent to those of ordinary skill in the art and that, therefore, would not facilitate a better understanding of the invention have not been presented in order to simplify the present description. Although only a limited number of embodiments of the present invention are necessarily described herein, one of ordinary skill in the art will, upon considering the foregoing description, recognize that many modifications and variations of the invention may be employed. All such variations and modifications of the invention are intended to be covered by the foregoing description and the following claims.

I claim:

1. A composite article that is one of a rotary cutting tool and a rotary cutting tool blank selected from a drill, a drill blank, an end mill, an end mill blank, a tap, and a tap blank, the composite article comprising an elongate portion including:

an outer region comprising a first cemented carbide; and an inner region autogenously bonded to the outer region and comprising a second cemented carbide;

wherein the outer region and the inner region are coaxially disposed with the inner region comprising a core region of the elongate portion;

wherein at least one of the first cemented carbide and the second cemented carbide comprises a hybrid cemented carbide comprising:

a cemented carbide dispersed phase; and a cemented carbide continuous phase;

wherein at least one of the cemented carbide dispersed phase and the cemented carbide continuous phase comprises at least 0.5 percent by weight of cubic carbide based on the weight of the phase comprising the cubic carbide; and wherein one of the first cemented carbide and the second cemented carbide is a non-hybrid cemented carbide, wherein the non-hybrid cemented carbide, the cemented carbide dispersed phase of the hybrid cemented carbide, and the cemented carbide continuous phase of the hybrid cemented carbide each independently comprise:

60 to 98 percent by weight of at least one transition metal carbide selected from the group consisting of titanium carbide, chromium carbide, vanadium carbide, zirconium carbide, hafnium carbide, tantalum carbide, molybdenum carbide, niobium carbide, and tungsten carbide; and 2 to 40 percent by weight a binder comprising at least one material selected from the group consisting of cobalt, a cobalt alloy, nickel, a nickel ally, iron, and an iron alloy.

2. The composite article of claim 1, wherein at least one of the cemented carbide dispersed phase and the cemented carbide continuous phase comprises at least 1.0 percent by weight of cubic carbide based on the weight of the phase comprising the cubic carbide.

3. The composite article of claim 1, wherein the cubic carbide comprises at least one of titanium carbide, vanadium carbide, zirconium carbide, niobium carbide, hafnium carbide, and tantalum carbide.

4. The composite article of claim 1, wherein at least one of the outer region and the inner region is substantially free of cubic carbide.

5. The composite article of claim 1, wherein a contiguity ratio of the cemented carbide dispersed phase in the hybrid cemented carbide is no greater than 0.48.

6. The composite article of claim 1, wherein substantially all of the cubic carbide in the hybrid cemented carbide is included in the cemented carbide dispersed phase of the hybrid cemented carbide.

7. The composite article of claim 1, wherein substantially all of the cubic carbide in the hybrid cemented carbide is included in the cemented carbide continuous phase of the hybrid cemented carbide.

8. The composite article of claim 1, wherein the cemented carbide dispersed phase comprises 2 to 50 percent by volume of the hybrid cemented carbide.

9. The composite article of claim 1, wherein the at least one transition metal carbide comprises tungsten carbide.

10. The composite article of claim 9, wherein the tungsten carbide has an average particle size of 0.3 to 10 micrometers.

11. The composite article of claim 1, wherein the binder comprises at least one alloying agent selected from the group consisting of tungsten, chromium, molybdenum, carbon, boron, silicon, copper, manganese, ruthenium, aluminum, and silver.

12. The composite article of claim 1, wherein the article is selected from a drill, an end mill, and a tap, wherein a surface of the elongate portion defines a cutting edge helically oriented about a surface of the elongate portion.

13. The composite article of claim 1, wherein the outer region comprises the hybrid cemented carbide.

14. The composite article of claim 1, wherein chemical wear resistance of the first cemented carbide differs from the chemical wear resistance of the second cemented carbide.

15. The composite article of claim 1, wherein at least one of the hardness and wear resistance of the first cemented carbide differs from the second cemented carbide.

16. The composite article of claim 1, wherein the modulus of elasticity of the first cemented carbide differs from the modulus of elasticity of the second cemented carbide.

17. The composite article of claim 1, wherein:

the composite article is selected from a drill, an end mill, and a tap; and a surface of the elongate portion defines a cutting edge.

18. The composite article of claim 17, wherein at least one of the cemented carbide dispersed phase and the cemented carbide continuous phase comprises at least 1.0 percent by weight of cubic carbide based on the weight of the phase comprising the cubic carbide.

19. The composite article of claim 17, wherein at least one of the outer region and the inner region is substantially free of cubic carbide.

20. The composite article of claim 17, wherein a contiguity ratio of the cemented carbide dispersed phase in the hybrid cemented carbide is no greater than 0.48.

21. The composite article of claim 17, wherein substantially all of the cubic carbide in the hybrid cemented carbide is included in the cemented carbide dispersed phase of the hybrid cemented carbide.

22. The composite article of claim 17, wherein substantially all of the cubic carbide in the hybrid cemented carbide is included in the cemented carbide continuous phase of the hybrid cemented carbide.

23. The composite article of claim 17, wherein the outer region comprises the hybrid cemented carbide.

24. The composite article of claim 17, wherein first cemented carbide differs from the second cemented carbide in at least one of chemical wear resistance, hardness, wear resistance, and modulus of elasticity.

25. The composite article of claim 1, wherein:

the composite article is selected from a drill blank, an end mill blank, and a tap blank.

26. The composite article of claim 25, wherein at least one of the cemented carbide dispersed phase and the cemented carbide continuous phase comprises at least 1.0 percent by weight of cubic carbide based on the weight of the phase comprising the cubic carbide.

27. The composite article of claim 25, wherein at least one of the outer region and the inner region is substantially free of cubic carbide.

28. The composite article of claim 25, wherein a contiguity ratio of the cemented carbide dispersed phase in the hybrid cemented carbide is no greater than 0.48.

29. The composite article of claim 25, wherein substantially all of the cubic carbide in the hybrid cemented carbide is included in the cemented carbide dispersed phase of the hybrid cemented carbide.

30. The composite article of claim 25, wherein substantially all of the cubic carbide in the hybrid cemented carbide is included in the cemented carbide continuous phase of the hybrid cemented carbide.

31. The composite article of claim 25, wherein the outer region comprises the hybrid cemented carbide.

32. The composite article of claim 25, wherein first cemented carbide differs from the second cemented carbide in at least one of chemical wear resistance, hardness, wear resistance, and modulus of elasticity.

33. The composite article of claim 1, wherein at least one of the cemented carbide dispersed phase and the cemented carbide continuous phase comprises 5 to 25 percent by weight of cubic carbide based on the weight of the phase comprising the cubic carbide.

34. The composite article of claim 1, wherein at least one of the cemented carbide dispersed phase and the cemented carbide continuous phase comprises about 6 percent by weight of cubic carbide based on the weight of the phase comprising the cubic carbide.

35. A composite article that is one of a rotary cutting tool and a rotary cutting tool blank selected from a drill, a drill blank, an end mill, an end mill blank, a tap, and a tap blank, the composite article comprising an elongate portion including:

an outer region comprising a first cemented carbide; and an inner region autogenously bonded to the outer region and comprising a second cemented carbide;

wherein the outer region and the inner region are coaxially disposed with the inner region comprising a core region of the elongate portion;

wherein at least one of the first cemented carbide and the second cemented carbide comprises a hybrid cemented carbide comprising:

a cemented carbide dispersed phase; and a cemented carbide continuous phase;

wherein the cemented carbide dispersed phase comprises at least 0.5 percent by weight of cubic carbide based on the weight of the dispersed phase and substantially all of the cubic carbide in the hybrid cemented carbide is included in the cemented carbide dispersed phase.

36. The composite article of claim 35, wherein the composite article is selected from a drill, an end mill and a tap.

37. The composite article of claim 35, wherein the composite article is selected from a drill blank, an end mill blank and a tap blank.

38. The composite article of claim 35, wherein at least one of the cemented carbide dispersed phase and the cemented carbide continuous phase comprises 5 to 25 percent by weight of cubic carbide based on the weight of the phase comprising the cubic carbide.

39. The composite article of claim 35, wherein at least one of the cemented carbide dispersed phase and the cemented carbide continuous phase comprises about 6 percent by weight of cubic carbide based on the weight of the phase comprising the cubic carbide.

40. A composite article that is one of a rotary cutting tool and a rotary cutting tool blank selected from a drill, a drill blank, an end mill, an end mill blank, a tap, and a tap blank, the composite article comprising an elongate portion including:

an outer region comprising a first cemented carbide; and an inner region autogenously bonded to the outer region and comprising a second cemented carbide;

wherein the outer region and the inner region are coaxially disposed with the inner region comprising a core region of the elongate portion;

wherein at least one of the first cemented carbide and the second cemented carbide comprises a hybrid cemented carbide comprising:

a cemented carbide dispersed phase; and a cemented carbide continuous phase;

wherein the cemented carbide continuous phase comprises at least 0.5 percent by weight of cubic carbide based on the weight of the continuous phase and substantially all of the cubic carbide in the hybrid cemented carbide is included in the cemented carbide continuous phase.

41. The composite article of claim 40, wherein the composite article is selected from a drill, an end mill and a tap.

42. The composite article of claim 40, wherein the composite article is selected from a drill blank, an end mill blank and a tap blank.

43. The composite article of claim 40, wherein at least one of the cemented carbide dispersed phase and the cemented carbide continuous phase comprises 5 to 25 percent by weight of cubic carbide based on the weight of the phase comprising the cubic carbide.

44. The composite article of claim 40, wherein at least one of the cemented carbide dispersed phase and the cemented carbide continuous phase comprises about 6 percent by weight of cubic carbide based on the weight of the phase comprising the cubic carbide.

* * * * *

UNITED STATES PATENT AND TRADEMARK OFFICE

CERTIFICATE OF CORRECTION

PATENT NO. : 8,876,443 B2
APPLICATION NO. : 13/550690
DATED : November 4, 2014
INVENTOR(S) : Mirchandani It is certified that error appears in the above-identified patent and that said Letters Patent is hereby corrected as shown below:

IN THE SPECIFICATION

In Column 9, Line 63, delete "a phase" and insert -- α phase --, therefor.

IN THE CLAIMS

In Column 24, Line 16, in Claim 1, delete "nickel ally," and insert -- nickel alloy, --, therefor.

Signed and Sealed this
Fourth Day of August, 2015

Michelle K. Lee

Michelle K. Lee
*Director of the United States Patent and Trademark Office*